US010451251B2

(12) United States Patent
Leung et al.

(10) Patent No.: US 10,451,251 B2
(45) Date of Patent: Oct. 22, 2019

(54) SOLID STATE LAMP WITH LIGHT DIRECTING OPTICS AND DIFFUSER

(71) Applicant: CREE, INC., Durham, NC (US)

(72) Inventors: Michael S. Leung, Ventura, CA (US); Eric J. Tarsa, Goleta, CA (US); John A. Edmond, Durham, NC (US)

(73) Assignee: IDEAL INDUSTRIES LIGHTING, LLC, Sycamore, IL (US)

( * ) Notice: Subject to any disclaimer, the term of this patent is extended or adjusted under 35 U.S.C. 154(b) by 30 days.

(21) Appl. No.: 13/758,763

(22) Filed: Feb. 4, 2013

(65) Prior Publication Data

US 2013/0214666 A1 Aug. 22, 2013

Related U.S. Application Data

(63) Continuation-in-part of application No. 13/029,068, filed on Feb. 16, 2011, now Pat. No. 10,359,151, and
(Continued)

(51) Int. Cl.
*F21V 13/00* (2006.01)
*F21V 13/04* (2006.01)
(Continued)

(52) U.S. Cl.
CPC ..... *F21V 13/04* (2013.01); *F21K 9/232* (2016.08); *F21K 9/64* (2016.08); *F21K 9/68* (2016.08);
(Continued)

(58) Field of Classification Search
CPC ..... F21Y 2103/003; F21Y 2105/001; F21Y 2105/003; F21V 29/506
(Continued)

(56) References Cited

U.S. PATENT DOCUMENTS 2,394,992 A 2/1946 Kurt ..... 362/311.12
3,143,592 A 8/1964 August ..... 174/16.3
(Continued)

FOREIGN PATENT DOCUMENTS

CN 1425117 6/2003
CN 1465106 A 12/2003
(Continued)

OTHER PUBLICATIONS

Decision of Dismissal of Amendment, Decision of Rejection from Japanese Patent Appl. No. 2011-231319, dated Oct. 15, 2013.
(Continued)

*Primary Examiner* — Gerald J Sufleta, II
(74) *Attorney, Agent, or Firm* — Ferguson Case Orr Paterson LLP

(57) ABSTRACT

Lamps and bulbs are disclosed generally comprising different combinations and arrangements of a light source, a reflective optical element, and a separate diffusing layer. This arrangement allows for the fabrication of lamps and bulbs that are efficient, reliable and cost effective and can provide an essentially omni-directional emission pattern, even with a light source comprised of an arrangement of LEDs. The lamps according to the present invention can also comprise thermal management features that provide for efficient dissipation of heat from the LEDs, which in turn allows the LEDs to operate at lower temperatures. The lamps can also comprise optical elements to help change the emission pattern from the generally directional pattern of the LEDs to a more omni-directional pattern.

79 Claims, 18 Drawing Sheets

Related U.S. Application Data a continuation-in-part of application No. 12/975,820, filed on Dec. 22, 2010, now Pat. No. 9,052,067, which is a continuation-in-part of application No. 12/889,719, filed on Sep. 24, 2010, now Pat. No. 9,523,488, which is a continuation-in-part of application No. 12/848,825, filed on Aug. 2, 2010, now Pat. No. 8,562,161.

(51) Int. Cl.

| | |
|---|---|
| ***F21V 7/00*** | (2006.01) |
| ***F21V 29/74*** | (2015.01) |
| ***F21K 9/232*** | (2016.01) |
| ***F21K 9/64*** | (2016.01) |
| ***F21K 9/68*** | (2016.01) |
| *F21V 13/02* | (2006.01) |
| *F21V 29/77* | (2015.01) |
| *F21Y 115/10* | (2016.01) |
| *F21Y 107/40* | (2016.01) |
| *F21V 3/08* | (2018.01) |
| *F21V 3/12* | (2018.01) |

(52) U.S. Cl.

CPC ..... *F21V 7/00* (2013.01); *F21V 7/0058* (2013.01); *F21V 29/74* (2015.01); *F21V 3/08* (2018.02); *F21V 3/12* (2018.02); *F21V 13/02* (2013.01); *F21V 29/773* (2015.01); *F21Y 2107/40* (2016.08); *F21Y 2115/10* (2016.08)

(58) Field of Classification Search

USPC ..... 362/186, 218, 217.14–217.16, 147, 158, 362/190

See application file for complete search history.

(56) References Cited

U.S. PATENT DOCUMENTS

| | | | | |
|---|---|---|---|---|
| 3,581,162 | A | 5/1971 | Wheatley | |
| 4,204,246 | A | 5/1980 | Arii et al. | 361/699 |
| 4,219,871 | A | 8/1980 | Larrimore | 362/264 |
| 4,727,289 | A | 2/1988 | Uchida | |
| 5,140,220 | A | 8/1992 | Hasegawa | |
| 5,463,280 | A | 10/1995 | Johnson | |
| 5,519,596 | A | 5/1996 | Woolverton | |
| 5,535,230 | A | 7/1996 | Abe | |
| 5,561,346 | A | 10/1996 | Byrne | |
| 5,581,683 | A | 12/1996 | Bertignoll et al. | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,838,101 | A | 11/1998 | Pappalardo | 313/487 |
| 5,850,126 | A | 12/1998 | Kanbar | |
| 5,890,794 | A | 4/1999 | Abtahi et al. | |
| 5,931,570 | A | 8/1999 | Yamuro | |
| 5,934,798 | A | 8/1999 | Roller et al. | 362/497 |
| 5,947,588 | A | 9/1999 | Huang | |
| 5,949,347 | A | 9/1999 | Wu | |
| 5,956,106 | A | 9/1999 | Petersen | |
| 5,959,316 | A | 9/1999 | Lowery | |
| 6,147,367 | A | 11/2000 | Yang et al. | 257/88 |
| 6,218,785 | B1 | 4/2001 | Incerti | 315/185 S |
| 6,220,722 | B1 | 4/2001 | Begemann | |
| 6,220,731 | B1 | 4/2001 | Ryan | 362/373 |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,270,722 | B1 | 8/2001 | Yang et al. | 422/37 |
| 6,276,822 | B1 | 8/2001 | Bedrosian et al. | |
| 6,350,041 | B1 | 2/2002 | Tarsa et al. | |
| 6,404,131 | B1 | 6/2002 | Kawano et al. | 315/82 |
| 6,465,961 | B1 | 10/2002 | Densen | |
| 6,517,221 | B1 | 2/2003 | Xie | 362/373 |
| 6,523,978 | B1 | 2/2003 | Huang | |
| 6,550,953 | B1 | 4/2003 | Ichikawa et al. | |
| 6,634,770 | B2 | 10/2003 | Densen | |
| 6,659,632 | B2 | 12/2003 | Chen | |
| 6,709,132 | B2 | 3/2004 | Ishibashi | |
| 6,746,885 | B2 | 6/2004 | Cao | 438/26 |
| 6,758,582 | B1 * | 7/2004 | Hsiao | F21V 7/0025 362/302 |
| 6,764,202 | B1 | 7/2004 | Herring et al. | 362/371 |
| 6,803,607 | B1 | 10/2004 | Chan et al. | |
| 6,848,819 | B1 | 2/2005 | Arndt et al. | |
| 6,860,620 | B2 | 3/2005 | Kuan et al. | 362/294 |
| 6,864,513 | B2 | 3/2005 | Lin et al. | |
| 6,910,794 | B2 | 6/2005 | Rice | 362/547 |
| 6,948,829 | B2 | 9/2005 | Verdes et al. | |
| 6,982,518 | B2 | 1/2006 | Chou et al. | |
| 6,997,580 | B2 | 2/2006 | Wong | 362/311.02 |
| 7,048,412 | B2 | 5/2006 | Martin et al. | |
| 7,080,924 | B2 | 6/2006 | Tseng et al. | |
| 7,086,756 | B2 | 8/2006 | Maxik | |
| 7,086,767 | B2 | 8/2006 | Sidwell et al. | |
| 7,094,362 | B2 | 8/2006 | Setlur et al. | 252/301 |
| 7,140,753 | B2 | 11/2006 | Wang et al. | 362/294 |
| 7,144,135 | B2 | 12/2006 | Martin et al. | |
| 7,160,012 | B2 | 1/2007 | Hilscher et al. | |
| 7,160,120 | B2 | 1/2007 | Zhang et al. | |
| 7,165,866 | B2 | 1/2007 | Li | |
| 7,172,314 | B2 | 2/2007 | Currie et al. | |
| 7,213,940 | B1 | 5/2007 | Van de Ven | |
| D546,980 | S | 7/2007 | Lo | |
| 7,250,715 | B2 | 7/2007 | Mueller | 313/485 |
| 7,270,446 | B2 | 9/2007 | Chang et al. | 362/294 |
| D553,267 | S | 10/2007 | Yuen | |
| 7,350,936 | B2 | 4/2008 | Ducharme et al. | 362/231 |
| 7,354,174 | B1 | 4/2008 | Yan | |
| 7,377,674 | B2 | 5/2008 | Klinkman et al. | 362/484 |
| 7,396,142 | B2 | 7/2008 | Laizure, Jr. et al. | |
| 7,405,857 | B2 | 7/2008 | Ma et al. | |
| 7,413,325 | B2 | 8/2008 | Chen | 362/249.01 |
| D581,556 | S | 11/2008 | To et al. | D26/2 |
| 7,547,124 | B2 | 6/2009 | Chang et al. | 362/373 |
| 7,549,782 | B2 | 6/2009 | Ng et al. | 362/555 |
| 7,553,047 | B2 | 6/2009 | Shin et al. | 362/294 |
| 7,588,351 | B2 | 9/2009 | Meyer et al. | 362/294 |
| 7,600,882 | B1 | 10/2009 | Morejon et al. | |
| 7,607,802 | B2 | 10/2009 | Kang et al. | 362/294 |
| 7,614,759 | B2 | 11/2009 | Negley | |
| 7,618,157 | B1 | 11/2009 | Galvez | |
| 7,663,152 | B2 | 2/2010 | Bierhuizen | |
| 7,663,315 | B1 | 2/2010 | Hulse | |
| 7,686,478 | B1 | 3/2010 | Hulse | |
| 7,740,365 | B2 | 3/2010 | Huttner et al. | 362/97 |
| 7,710,016 | B2 | 5/2010 | Miki | 257/98 |
| 7,726,836 | B2 | 6/2010 | Chen | |
| 7,753,568 | B2 | 7/2010 | Hu et al. | 362/373 |
| 7,810,954 | B2 | 10/2010 | Kolodin | 362/277 |
| 7,824,065 | B2 | 11/2010 | Maxik | |
| D629,928 | S | 12/2010 | Chen | |
| 7,884,538 | B2 | 2/2011 | Mitsuishi et al. | 313/502 |
| 7,909,481 | B1 * | 3/2011 | Zhang | F21S 6/002 362/249.02 |
| 7,976,335 | B2 | 7/2011 | Weber et al. | 439/487 |
| 7,989,236 | B2 | 8/2011 | Yamaguchi et al. | 438/26 |
| 8,021,025 | B2 | 9/2011 | Lee | |
| 8,235,571 | B2 | 8/2012 | Park | 362/555 |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,309,969 | B2 | 11/2012 | Suehiro et al. | 257/79 |
| 8,314,537 | B2 | 11/2012 | Gielen et al. | 313/46 |
| 8,322,896 | B2 | 12/2012 | Falicoff et al. | |
| 8,348,470 | B2 | 1/2013 | Liu et al. | 362/294 |
| 8,368,100 | B2 | 2/2013 | Donofrio et al. | |
| 8,371,722 | B2 | 2/2013 | Carroll | |
| 8,400,051 | B2 | 3/2013 | Hakata et al. | |
| 8,410,512 | B2 | 4/2013 | Andrews | 257/99 |

(56) References Cited

U.S. PATENT DOCUMENTS 8,415,865 B2 4/2013 Liang et al.
8,421,320 B2 4/2013 Chuang
8,421,321 B2 4/2013 Chuang
8,421,322 B2 4/2013 Carroll et al.
8,449,154 B2 5/2013 Uemoto et al.
8,502,468 B2 8/2013 Li et al.
8,568,009 B2 10/2013 Chiang et al. ..... 362/563
8,760,042 B2 1/2014 Sakai et al.
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,922,106 B2 12/2014 Helbing et al. ..... 313/318.11
9,316,386 B2 * 4/2016 Breidenassel ..... F21V 29/505
2002/0047516 A1 4/2002 Iwasa et al. ..... 313/512
2002/0114169 A1 8/2002 Harada ..... 362/558
2003/0021113 A1 1/2003 Begemann
2003/0038291 A1 2/2003 Cao
2003/0081419 A1 5/2003 Jacob ..... 362/364
2003/0185005 A1 10/2003 Sommers et al.
2004/0021629 A1 2/2004 Sasuga et al.
2004/0159846 A1 8/2004 Doxsee
2004/0201990 A1 10/2004 Neyer
2004/0223315 A1 11/2004 Suehiro et al. ..... 362/84
2005/0068776 A1 3/2005 Ge ..... 362/296.08
2005/0168990 A1 8/2005 Nagata et al. ..... 362/294
2005/0174780 A1 * 8/2005 Park ..... 362/294
2005/0184638 A1 8/2005 Mueller ..... 313/485
2005/0219060 A1 * 10/2005 Curran et al. ..... 340/815.45
2005/0225988 A1 10/2005 Chaves et al.
2005/0242711 A1 11/2005 Bloomfield
2005/0253153 A1 11/2005 Harada
2005/0276053 A1 12/2005 Nortrup et al. ..... 362/294
2006/0067640 A1 * 3/2006 Hsieh ..... F21V 7/0091 385/146
2006/0097245 A1 5/2006 Aanegola et al. ..... 257/26
2006/0097385 A1 5/2006 Negley ..... 257/722
2006/0115482 A1 5/2006 Alferink et al. ..... 438/22
2006/0126343 A1 * 6/2006 Hsieh ..... F21K 9/00 362/327
2006/0138435 A1 6/2006 Tarsa et al. ..... 257/89
2006/0152140 A1 7/2006 Brandes ..... 313/503
2006/0152820 A1 7/2006 Lien et al. ..... 359/726
2006/0180774 A1 8/2006 Endo ..... 250/485.1
2006/0227558 A1 10/2006 Osawa et al.
2006/0250792 A1 * 11/2006 Izardel ..... F21V 3/02 362/231
2006/0268555 A1 * 11/2006 Kelly ..... F21L 14/023 362/341
2007/0047232 A1 3/2007 Kim et al.
2007/0090737 A1 4/2007 Hu et al. ..... 313/11
2007/0091633 A1 4/2007 Harrity et al.
2007/0139938 A1 6/2007 Petroski
2007/0139949 A1 6/2007 Tanda et al. ..... 362/551
2007/0158668 A1 7/2007 Tarsa et al. ..... 257/98
2007/0165408 A1 7/2007 Li
2007/0182299 A1 8/2007 Ouderkirk ..... 313/110
2007/0206375 A1 9/2007 Lys
2007/0215890 A1 9/2007 Harbers et al.
2007/0223219 A1 9/2007 Medendorp
2007/0263405 A1 11/2007 Ng et al. ..... 362/555
2007/0267976 A1 11/2007 Bohler
2007/0274080 A1 11/2007 Negley et al. ..... 362/341
2007/0285924 A1 12/2007 Morris et al. ..... 362/264
2007/0297183 A1 12/2007 Coushaine
2008/0037257 A1 2/2008 Bolta
2008/0055908 A1 3/2008 Wu et al. ..... 362/294
2008/0062694 A1 3/2008 Lai et al. ..... 362/294
2008/0067640 A1 3/2008 Do et al.
2008/0080165 A1 4/2008 Kim et al.
2008/0084701 A1 4/2008 Van de Ven
2008/0093615 A1 4/2008 Lin
2008/0106893 A1 5/2008 Johnson et al.
2008/0117620 A1 5/2008 Hama et al. ..... 362/84
2008/0128735 A1 6/2008 Yoo et al.
2008/0149166 A1 6/2008 Beeson et al. ..... 136/248
2008/0173884 A1 7/2008 Chitnis et al. ..... 257/98
2008/0179611 A1 7/2008 Chitnis et al. ..... 257/98
2008/0192458 A1 8/2008 Li
2008/0232119 A1 9/2008 Ribarich ..... 362/373
2008/0285279 A1 11/2008 Ng et al. ..... 362/249
2008/0308825 A1 12/2008 Chakraborty et al. ..... 257/98
2009/0001399 A1 1/2009 Diana et al. ..... 257/98
2009/0015137 A1 1/2009 Su et al. ..... 313/503
2009/0040760 A1 2/2009 Chen et al. ..... 362/249
2009/0046473 A1 2/2009 Tsai et al. ..... 362/373
2009/0058256 A1 3/2009 Mitsuishi et al. ..... 313/487
2009/0059559 A1 3/2009 Pabst
2009/0067180 A1 3/2009 Tahmosybayat ..... 362/339
2009/0086492 A1 4/2009 Meyer
2009/0086508 A1 4/2009 Bierhuizen ..... 362/617
2009/0095960 A1 4/2009 Murayama ..... 257/79
2009/0100213 A1 4/2009 Li
2009/0101930 A1 4/2009 Li
2009/0103293 A1 * 4/2009 Harbers ..... F21S 10/02 362/231
2009/0103296 A1 4/2009 Harbers et al.
2009/0113296 A1 4/2009 Harbers et al.
2009/0116217 A1 5/2009 Teng et al.
2009/0140633 A1 6/2009 Tanimoto ..... 313/503
2009/0141474 A1 6/2009 Kolodin
2009/0147179 A1 6/2009 Yamashita
2009/0161356 A1 6/2009 Negley et al. ..... 362/231
2009/0175041 A1 7/2009 Yuen et al.
2009/0184618 A1 7/2009 Hakata et al.
2009/0190353 A1 7/2009 Barker ..... 362/249
2009/0195186 A1 8/2009 Guest et al. ..... 315/294
2009/0201679 A1 8/2009 Konaka ..... 362/235
2009/0207607 A1 * 8/2009 Haase ..... F21K 9/13 362/234
2009/0208307 A1 8/2009 Haase ..... 362/234
2009/0213595 A1 8/2009 Alexander et al. ..... 362/373
2009/0217970 A1 9/2009 Zimmerman et al. ..... 136/252
2009/0262516 A1 10/2009 Li ..... 362/84
2009/0273727 A1 11/2009 Kubota et al. ..... 349/62
2009/0273924 A1 11/2009 Chiang ..... 362/241
2009/0283779 A1 11/2009 Negley et al. ..... 257/88
2009/0286337 A1 11/2009 Lee ..... 438/27
2009/0296387 A1 12/2009 Reisenauer
2009/0310368 A1 * 12/2009 Incerti ..... F21V 7/0091 362/326
2009/0316073 A1 12/2009 Chen et al. ..... 349/64
2009/0316383 A1 12/2009 Son
2009/0322197 A1 12/2009 Helbing ..... 445/48
2009/0322208 A1 12/2009 Shaikevitch ..... 313/503
2009/0322800 A1 12/2009 Atkins ..... 345/690
2009/0323333 A1 12/2009 Chang
2010/0020547 A1 1/2010 Olsson ..... 362/311
2010/0025700 A1 2/2010 Jung et al. ..... 257/89
2010/0026185 A1 2/2010 Betsuda
2010/0027258 A1 2/2010 Maxik et al. ..... 362/240
2010/0038660 A1 2/2010 Shuja ..... 257/98
2010/0046231 A1 2/2010 Medinis ..... 362/294
2010/0060130 A1 3/2010 Li
2010/0060144 A1 3/2010 Justel et al. ..... 313/503
2010/0079061 A1 4/2010 Tsai ..... 313/504
2010/0091487 A1 4/2010 Shin ..... 362/235
2010/0096967 A1 4/2010 Marinus et al. ..... 313/46
2010/0102707 A1 4/2010 Fukuda et al. ..... 313/503
2010/0134047 A1 6/2010 Hasnain
2010/0140655 A1 6/2010 Shi ..... 257/99
2010/0149783 A1 6/2010 Takenaka et al. ..... 362/84
2010/0149814 A1 6/2010 Zhai et al. ..... 257/88
2010/0170075 A1 7/2010 Kanade et al. ..... 29/428
2010/0177522 A1 7/2010 Lee ..... 362/373
2010/0201284 A1 8/2010 Kraus
2010/0207502 A1 8/2010 Cao et al. ..... 313/46
2010/0219735 A1 9/2010 Sakai et al. ..... 313/46
2010/0232134 A1 9/2010 Tran ..... 362/84
2010/0244729 A1 * 9/2010 Chen et al. ..... 315/291
2010/0246165 A1 * 9/2010 Diaz et al. ..... 362/183
2010/0014839 A1 10/2010 Benoy et al. ..... 386/117

(56) References Cited

U.S. PATENT DOCUMENTS

| | | | | |
|---|---|---|---|---|
| 2010/0259918 | A1 | 10/2010 | Rains, Jr. | 362/84 |
| 2010/0264799 | A1 | 10/2010 | Liu et al. | 313/46 |
| 2010/0264826 | A1 | 10/2010 | Yatsuda | 315/112 |
| 2010/0314985 | A1* | 12/2010 | Premysler | 313/46 |
| 2010/0314996 | A1 | 12/2010 | Van de Ven | |
| 2010/0327745 | A1 | 12/2010 | Dassanayake | |
| 2010/0327755 | A1 | 12/2010 | Dassanayake | 315/35 |
| 2010/0328925 | A1 | 12/2010 | Hoelen | 362/84 |
| 2011/0001151 | A1 | 1/2011 | Le Toquin | |
| 2011/0037368 | A1 | 2/2011 | Huang | 313/46 |
| 2011/0044022 | A1* | 2/2011 | Ko et al. | 362/84 |
| 2011/0215699 | A1 | 2/2011 | Le et al. | |
| 2011/0058379 | A1* | 3/2011 | Diamantidis | 362/296.01 |
| 2011/0068356 | A1 | 3/2011 | Chiang | 257/98 |
| 2011/0074271 | A1 | 3/2011 | Takeshi et al. | 313/46 |
| 2011/0074296 | A1 | 3/2011 | Shen et al. | 315/112 |
| 2011/0080096 | A1 | 4/2011 | Dudik et al. | 315/112 |
| 2011/0080740 | A1 | 4/2011 | Allen | 362/294 |
| 2011/0080742 | A1 | 4/2011 | Allen | |
| 2011/0089804 | A1 | 4/2011 | Mahalingam et al. | 313/46 |
| 2011/0089830 | A1 | 4/2011 | Pickard et al. | 315/32 |
| 2011/0095686 | A1 | 4/2011 | Falicoff | |
| 2011/0133222 | A1 | 6/2011 | Allen et al. | 257/88 |
| 2011/0149563 | A1* | 6/2011 | Hsia | F21V 25/04 362/221 |
| 2011/0149578 | A1 | 6/2011 | Niiyama | 362/294 |
| 2011/0157898 | A1* | 6/2011 | Kanai | F21V 5/04 362/296.05 |
| 2011/0157989 | A1 | 6/2011 | Kanai | |
| 2011/0175528 | A1 | 7/2011 | Rains et al. | 315/51 |
| 2011/0176291 | A1 | 7/2011 | Sanders | |
| 2011/0176316 | A1 | 7/2011 | Phipps et al. | |
| 2011/0205733 | A1 | 8/2011 | Lenderink et al. | 362/231 |
| 2011/0215696 | A1 | 9/2011 | Tong | |
| 2011/0215697 | A1 | 9/2011 | Tong | |
| 2011/0216523 | A1 | 9/2011 | Tong et al. | 362/84 |
| 2011/0242816 | A1 | 10/2011 | Chowdhury et al. | 362/294 |
| 2011/0267835 | A1* | 11/2011 | Boonekamp et al. | 362/555 |
| 2011/0273072 | A1 | 11/2011 | Oki | 313/46 |
| 2011/0278609 | A1 | 11/2011 | Jeong | 257/98 |
| 2011/0291560 | A1* | 12/2011 | Wang et al. | 315/32 |
| 2011/0298371 | A1 | 12/2011 | Brandes et al. | 315/32 |
| 2012/0040585 | A1 | 2/2012 | Huang | |
| 2012/0155059 | A1 | 6/2012 | Hoelen et al. | 362/84 |
| 2012/0161626 | A1 | 6/2012 | Van de Ven et al. | 315/35 |
| 2012/0241778 | A1* | 9/2012 | Franck | F21V 7/0008 257/88 |
| 2012/0320591 | A1 | 12/2012 | Liao et al. | 362/249 |
| 2013/0049018 | A1 | 2/2013 | Ramer et al. | 257/81 |
| 2013/0063945 | A1 | 3/2013 | Wu et al. | 362/249 |
| 2013/0119280 | A1 | 5/2013 | Fuchi et al. | 250/504 R |
| 2013/0249374 | A1 | 9/2013 | Lee et al. | 313/12 |
| 2013/0293098 | A1 | 11/2013 | Li et al. | 313/512 |

FOREIGN PATENT DOCUMENTS

| | | | |
|---|---|---|---|
| CN | 1608326 | | 4/2005 |
| CN | 1726410 | | 1/2006 |
| CN | 1802533 | | 7/2006 |
| CN | 1922286 | A | 2/2007 |
| CN | 101012916 | A | 8/2007 |
| CN | 101128695 | | 2/2008 |
| CN | 10126232 | A | 9/2008 |
| CN | 101262032 | | 9/2008 |
| CN | 101262032 | A | 9/2008 |
| CN | 1013388887 | A | 1/2009 |
| CN | 101368719 | A | 2/2009 |
| CN | 101440938 | A | 5/2009 |
| CN | 101501388 | A | 8/2009 |
| CN | 101641623 | | 2/2010 |
| CN | 102077011 | | 5/2011 |
| CN | 102859258 | A | 1/2013 |
| DE | 4311937 | A1 | 10/1994 |
| DE | 10251955 | | 5/2004 |
| DE | 10251955 | A1 | 5/2004 |
| DE | 102004051382 | | 4/2006 |
| DE | 102006061164 | | 6/2008 |
| DE | 10 2007 037862 | A1 | 10/2008 |
| DE | 202008013667 | | 12/2008 |
| DE | 102011004718 | | 8/2012 |
| EP | 0876085 | | 11/1998 |
| EP | 0876085 | A2 | 11/1998 |
| EP | 0890059 | A1 | 1/1999 |
| EP | 0936682 | A1 | 8/1999 |
| EP | 1058221 | A2 | 12/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 1423011 | | 1/1976 |
| GB | 2345954 | A | 7/2000 |
| GB | 2 366 610 | A | 3/2002 |
| GB | 2366610 | | 3/2002 |
| GB | 2366610 | A | 3/2002 |
| JP | H11-177149 | | 2/1991 |
| JP | H03081903 | | 4/1991 |
| JP | H06283006 | | 10/1994 |
| JP | H09265807 | | 10/1997 |
| JP | H1177149 | | 3/1999 |
| JP | H11177149 | | 7/1999 |
| JP | 11-213730 | A | 8/1999 |
| JP | H11260125 | | 9/1999 |
| JP | 2000022222 | | 1/2000 |
| JP | 2000173304 | | 6/2000 |
| JP | 2001118403 | | 4/2001 |
| JP | 2002525814 | | 8/2002 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 2005108700 | | 4/2005 |
| JP | 20051008700 | | 4/2005 |
| JP | 2005244226 | | 9/2005 |
| JP | 2005-277127 | | 10/2005 |
| JP | 2005-286267 | A | 10/2005 |
| JP | 2005277127 | | 10/2005 |
| JP | 2005021635 | | 11/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | WO 2006065558 | | 6/2006 |
| JP | 200640850 | A | 9/2006 |
| JP | 2006525648 | | 11/2006 |
| JP | 2006331683 | | 12/2006 |
| JP | 2007-49019 | | 2/2007 |
| JP | 2007049019 | | 2/2007 |
| JP | A2007049019 | | 2/2007 |
| JP | 200759930 | | 3/2007 |
| JP | 2007059911 | | 3/2007 |
| JP | 2007081090 | | 3/2007 |
| JP | 2007/173397 | A | 7/2007 |
| JP | 2007-184330 | | 7/2007 |
| JP | 2007173397 | | 7/2007 |
| JP | 2007184330 | | 7/2007 |
| JP | 3138653 | | 12/2007 |
| JP | 2008505448 | | 2/2008 |
| JP | 2008-508742 | | 3/2008 |
| JP | 2008508742 | | 3/2008 |
| JP | 200815707 | | 4/2008 |
| JP | 2008091140 | | 4/2008 |
| JP | 2008108835 | | 5/2008 |
| JP | 2008-523639 | | 7/2008 |
| JP | 2008523639 | | 7/2008 |
| JP | 2008-187195 | | 8/2008 |
| JP | 2008187195 | | 8/2008 |
| JP | 2008-262765 | | 10/2008 |
| JP | 2008262765 | | 10/2008 |
| JP | 200828183 | | 11/2008 |
| JP | 2008288409 | | 11/2008 |
| JP | 2008300117 | | 12/2008 |

(56) References Cited

FOREIGN PATENT DOCUMENTS

| | | | |
|---|---|---|---|
| JP | 2008300203 | | 12/2008 |
| JP | 2008300460 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009-59896 | | 3/2009 |
| JP | 2009059896 | | 3/2009 |
| JP | 200916689 | | 4/2009 |
| JP | 2009117346 | | 5/2009 |
| JP | WO 2009093163 | | 7/2009 |
| JP | U3153766 | | 8/2009 |
| JP | 2009238960 | | 10/2009 |
| JP | WO 2009119038 | | 10/2009 |
| JP | 2009-267039 | | 11/2009 |
| JP | 2009266780 | | 11/2009 |
| JP | 2009277586 | | 11/2009 |
| JP | 2009148543 | | 12/2009 |
| JP | 2009295299 | | 12/2009 |
| JP | WO 2009148543 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |
| JP | 2010267826 | | 11/2010 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | 200505054 | | 2/2005 |
| TW | 200507686 | | 2/2005 |
| TW | 200527664 | | 8/2005 |
| TW | 200618339 | | 6/2006 |
| TW | 200619744 | | 6/2006 |
| TW | M309750 | | 4/2007 |
| TW | 200739151 | | 10/2007 |
| TW | 200806922 | | 2/2008 |
| TW | 200907239 | | 2/2009 |
| TW | 200928435 | | 7/2009 |
| TW | 200930937 | | 7/2009 |
| TW | 200938768 | | 9/2009 |
| TW | 200943592 | | 10/2009 |
| TW | D134005 | | 3/2010 |
| TW | 100300960 | | 3/2011 |
| TW | D141681 | | 7/2011 |
| WO | WO 2000/017569 | A1 | 3/2000 |
| WO | WO 0124583 | A1 | 4/2001 |
| WO | WO 2001/040702 | A1 | 6/2001 |
| WO | WO 0160119 | A2 | 8/2001 |
| WO | WO 2004068599 | | 8/2004 |
| WO | WO 2004/100213 | A2 | 11/2004 |
| WO | WO 2004100213 | | 11/2004 |
| WO | WO 2004100213 | A2 | 11/2004 |
| WO | WO 2005107420 | A2 | 11/2005 |
| WO | WO 2006012043 | | 2/2006 |
| WO | WO 06059535 | A2 | 6/2006 |
| WO | WO 2006065558 | | 6/2006 |
| WO | WO 2007/130358 | A2 | 11/2007 |
| WO | WO 2007146566 | A2 | 12/2007 |
| WO | WO 2008/018002 | A2 | 2/2008 |
| WO | WO 2008018002 | | 2/2008 |
| WO | WO 2008/052318 | A1 | 5/2008 |
| WO | WO 2008/117211 | A1 | 10/2008 |
| WO | WO 04100213 | A2 | 11/2008 |
| WO | WO 08134056 | A1 | 11/2008 |
| WO | WO 2008/146229 | A2 | 12/2008 |
| WO | WO 2008146229 | | 12/2008 |
| WO | WO 2009/024952 | A2 | 2/2009 |
| WO | WO 2009028861 | | 3/2009 |
| WO | WO 2009052099 | | 4/2009 |
| WO | WO 2009/091562 | A2 | 7/2009 |
| WO | WO 2009/093163 | A2 | 7/2009 |
| WO | WO 2009091562 | | 7/2009 |
| WO | WO 2009093163 | | 7/2009 |
| WO | WO 2009093163 | A2 | 7/2009 |
| WO | WO 2009/107052 | A1 | 9/2009 |
| WO | WO 2009107052 | | 9/2009 |
| WO | WO 2009/119038 | A2 | 10/2009 |
| WO | WO 2009/128004 | A1 | 10/2009 |
| WO | WO 2009119038 | | 10/2009 |
| WO | WO 2009125314 | A2 | 10/2009 |
| WO | WO 2009131627 | | 10/2009 |
| WO | WO 2009143047 | A2 | 11/2009 |
| WO | WO 2009/158422 | A1 | 12/2009 |
| WO | WO 2009158422 | | 12/2009 |
| WO | WO 2009158422 | A1 | 12/2009 |
| WO | WO 2010/012999 | A2 | 2/2010 |
| WO | WO 2010/013893 | | 2/2010 |
| WO | WO 2010012999 | | 2/2010 |
| WO | WO 2010013893 | | 2/2010 |
| WO | WO 2010013898 | A2 | 2/2010 |
| WO | WO 2010052640 | | 5/2010 |
| WO | WO 2010/119618 | A1 | 10/2010 |
| WO | WO 2010/128419 | A1 | 11/2010 |
| WO | WO 2011100193 | | 8/2011 |
| WO | WO 2011109091 | A1 | 9/2011 |
| WO | WO 2011109098 | | 9/2011 |
| WO | WO 2012011279 | | 1/2012 |
| WO | WO 2012031533 | | 3/2012 |

OTHER PUBLICATIONS

Office Action from Japanese Patent Appl. No. 2012-556063, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028,913, dated Nov. 4, 2013.
Office Action from Japanese Patent Appl. No. 2012-556064, dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.
Office Action from U.S. Appl. No. 13/029,068, dated Sep. 26, 2014.
Response to OA from U.S. Appl. No. 13/029,068, filed Nov. 18, 2014.
Office Action from U.S. Appl. No. 13/358,901, dated Oct. 31, 2014.
Office Action from U.S. Appl. No. 13/430,478, dated Nov. 5, 2014.
Office Action from U.S. Appl. No. 13/034,501, dated Nov. 5, 2014.
Office Action from U.S. Appl. No. 13/028,863, dated Nov. 10, 2014.
Decision to Grant from Japanese Appl. No. 2012-556062, dated Nov. 27, 2014.
Second Office Action from Chinese Patent Appl. No. 2011800207069, dated Dec. 5, 2014.
Second Office Action from Chinese Appl. No. 201080062056.X, dated Sep. 29, 2014.
First Office Action and Search Report from Chinese Appl. No. 2011800223856, dated Aug. 1, 2014.
Communication from European Appl. No. 12816621.2-1757, dated Sep. 25, 2014.
Pretrial Report from Japanese Patent Appl. No. 2011-231319, dated Apr. 14, 2014.
Summons to Oral Proceedings from European Patent Appl. No. 09152962/2166580, dated Jan. 29, 2015.
First Office Action from Chinese Patent Appl. No. 2011800225832, dated Jan. 20, 2015.
First Office Action from Chinese Patent Appl No. 2011800226214, dated Dec. 25, 2014.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.

(56) References Cited

OTHER PUBLICATIONS

Office Action from U.S. Appl. No. 13/034,501, dated Jan. 23, 2014.
Search Report and Written Opinion from PCT Application No. PCT/US2012/072108, dated Feb. 27, 2013.
First Office Action from Chinese Patent Appl. No. 201080062056.X, dated Feb. 12, 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/430,478, dated Feb. 21, 2014.
Office Action from U.S. Appl. No. 13/358,901, dated Mar. 6, 2014.
Office Action from U.S. Appl. No. 13/018,291, dated Mar. 7, 2014.
Office Action from U.S. Appl. No. 13/029,025, dated Mar. 19, 2014.
Office Action from Japanese Patent Appl. No. 2012-556066, dated Mar. 14, 2014.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
First Office Action from Chinese Patent Application No. 2011800207069, dated May 5, 2014.
First Office Action from Chinese Patent Application No. 201180022606, dated May 4, 2014.
First Office Action from Chinese Patent Appl. No. 201180020709.2, dated May 4, 2014.
Office Action from U.S. Appl. No. 13/028,946, dated May 27, 2014.
Office Action from U.S. Appl. No. 13/028,913, dated May 22, 2014.
Office Action from U.S. Appl. No. 13/029,066, dated Jun. 13, 2014.
Office Action from U.S. Appl. No. 13/028,946, dated Jul. 16, 2012.
Response to OA from U.S. Appl. No. 13/028,946, filed Oct. 8, 2012.
Office Action from U.S. Appl. No. 13/029,025, dated Jul. 16, 2013.
Office Action from U.S. Appl. No. 13/430,478, dated Jun. 18, 2013.
Office Action from U.S. Appl. No. 12/901,405, dated Jul. 1, 2013.
Office Action from U.S. Appl. No. 13/018,291, dated Oct. 10, 2012.
Response to OA from U.S. Appl. No. 13/018,291, filed Jan. 7, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.
Office Action from U.S. Appl. No. 13/028,946, dated Dec. 4, 2012.
Response to OA from U.S. Appl. No. 13/028,946, filed Jan. 29, 2013.
Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to OA from U.S. Appl. No. 12/848,825, filed Feb. 5, 2013.
Office Action from U.S. Appl. No. 13/029,005, dated Jun. 11, 2013.
First Office Action and Search Report from Chinese Patent Appl. No. 201180022620X, dated Jul. 1, 2014.
Office Action from U.S. Appl. No. 13/358,901, dated Jul. 15, 2014.
Response to OA from U.S. Appl. No. 13/358,901, filed Aug. 21, 2014.
Office Action from U.S. Appl. No. 13/340,478, dated Jul. 23, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/985,275, dated Aug. 7, 2014.
Office Action from U.S. Appl. No. 12/901,405, dated Aug. 7, 2014.
First Office Action from Chinese Patent Appl. No. 2011800223856, dated Aug. 1, 2014.
First Office Action from Chinese Patent Appl. No. 2011800226248, dated Aug. 25, 2014.
Official Action from European Patent Appl. No. 11710348.1-1757, dated Oct. 9, 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
Office Action from U.S. Appl. No. 13/022,490, dated Oct. 17, 2013.
Office Action from U.S. Appl. No. 11/149,999, dated May 13, 2013.
Response to OA from Patent Appl. No. 11/149,999, filed Sep. 13, 2013.
Office Action from U.S. Appl. No. 12/985,275, dated Aug. 27, 2013.
Office Action from U.S. Appl. No. 13/358,901, dated Oct. 9, 2013.
Office Action from U.S. Appl. No. 13/028,863, dated Jul. 30, 2013.
Second Office Action and Search Report from Chinese Patent Appl. No. 2011800207092, dated Jan. 22, 2015.
Examination Report from European Patent Appl. No. 11 710 348.1-1757, dated Feb. 18, 2015.
Examination Report from European Patent Appl. No. 11 710 906.6-1757, dated Feb. 18, 2015.
Examination Report from European Patent Appl. No. 12 740 244.4-1757, dated Feb. 9, 2015.
Office Action from U.S. Appl. No. 13/029,063, dated Jan. 13, 2015.
Office Action from U.S. Appl. No. 14/014,272, dated Jan. 14, 2015.
Response to OA from U.S. Appl. No. 14/014,272, filed Mar. 3, 2015.
Office Action from U.S. Appl. No. 12/901,405, dated Feb. 4, 2015.
U.S. Appl. No. 13/649,052, filed Oct. 10, 2012, Lowes, et al.
U.S. Appl. No. 13/649,067, filed Oct. 10, 2012, Lowes, et al.
WhiteOptics™ White97 Film, Reflector Film Technical Data Sheet from WhiteOptics, LLC, New Castel, DE.
WhiteOptics™ Metal, Technical Data Sheet from WhiteOptics, LLC, New Castel, DE.
International Search Report and Written Opinion from PCT Application No. PCT/US2012/044705 dated Oct. 9, 2012.
Notice to Submit a Response from Korean Patent Application No. 30-2011-0008446, dated Oct. 22, 2012.
Notice to Submit a Response from Korean Design Patent Application No. 30-2011-0024961, dated Sep. 10, 2012.
U.S. Appl. No. 12/757,179, filed Apr. 9, 2010, Yuan, et al.
U.S. Appl. No. 12/901,405, filed Oct. 8, 2010, Tong.
U.S. Appl. No. 61/339,515, filed Mar. 3, 2010, Tong.
U.S. Appl. No. 12/975,820, Van De Ven.
U.S. Appl. No. 13/029,063, filed Feb. 16, 2011, Hussell.
U.S. Appl. No. 13/358,901, filed Feb. 26, 2012, Progl, et al.
US Publication No. 2005/0242711 AI, Date Nov. 3, 2005 Bloomfield.
US Publication No. 2002/0047516 A1, Date Apr. 25, 2002 Iwasa.
US Publication No. 2007/0263405 A1, Date Nov. 15, 2007 Ng.
U.S. Appl. No. 13/018,245, filed Jan. 31, 2011, Tong.
U.S. Appl. No. 12/848,825, filed Aug. 2, 2010, Tong.

(56) References Cited

OTHER PUBLICATIONS

U.S. Appl. No. 13/017,778, filed Jan. 31, 2011, Andrews.
International Search Report and Written Opinion for PCT Patent Application No. PCT/US2011/000405 dated Nov. 2, 2011.
Notice to Submit a Response from Korean Patent Application No. 30-2011-0008448, dated Apr. 16, 2012.
Notice to Submit a Response from Korean Patent Application No. 30-2011-0008445, dated Apr. 16, 2012.
Notice to Submit a Response from Korean Patent Application No. 30-2011-0008446, dated Apr. 16, 2012.
Office Action for Taiwanese Patent Application No. 100300961, dated May 7, 2012.
Office Action from Taiwanese Patent Application No. 100300960, dated May 7, 2012.
Office Action of the IPO for Taiwan Patent Application No. TW 100300962 dated Nov. 21, 2011.
Office Action of the IPO for Taiwan Patent Application No. TW 100300961 dated Nov. 16, 2011.
Office Action of the IPO for Taiwan Patent Application No. TW 100300960 dated Nov. 15, 2011.
Office Action of the IPO for Taiwan Patent Application No. TW 100302770 dated Jan. 13, 2012.
International Search Report and Written Opinion for PCT Application No. PCT/US2011/000391 dated Oct. 6, 2011.
International Search Report and Written Opinion, PCT/US2009/063804, dated Feb. 26, 2010.
U.S. Appl. No. 12/566,195, Van De Ven, filed Sep. 24, 2009.
U.S. Appl. No. 12/704,730, Van De Ven, filed Feb. 12, 2010.
C.Crane Geobulb®-II LED Light Bulb, Item #2SW, Description, p. 1-2.
Cree LR4, 4" and 6" Recessed Architectural Downlight, Product Info p. 1-2.
International Search Report and Written Opinion for PCT/US2011/000407 dated Nov. 16, 2011.
International Search Report and Written Opinion for PCT/US2011/000400 dated May 2, 2011.
International Search Report and Written Opinion for PCT Application No. PCT/US2011/000399 dated Jul. 12, 2011.
Decision to Refuse a European Patent Application for EP 09 152 962.8 dated Jul. 6, 2011.
International Search Report and Written Opinion for PCT Application No. PCT/US2011/000402 dated Sep. 30, 2011.
International Search Report and Written Opinion for PCT/US2011/000398 dated Aug. 30, 2011.
International Search Report and Written Opinion for PCT/US2011/000406 dated Sep. 15, 2011.
International Search Report and Written Opinion for counterpart PCT Application No. PCT/US2011/000397 dated May 24, 2011.
International Search Report and Written Opinion for PCT/US2011/000403 dated Aug. 23, 2011.
International Search Report and Written Opinion for PCT/US2011/000404 dated Aug. 25, 2011.
U.S. Appl. No. 61/435,759, filed Jan. 24, 2011 Le.
U.S. Appl. No. 61/339,516, filed Mar. 3, 2010 Tong.
US Publication No. 2010/0155763, filed Jun. 24, 2010 Donofrio.
U.S. Appl. No. 61/424,670, filed Dec. 19, 2010, Zongjie Yuan.
Cree, XLAMP® LEDs, Product Info and Data Sheets, 34 Pages.
Nichia Corp Part Spec. *High Brightness LEDs*, (May 1999), 15 Pgs EA, (NSPW 300BS, NSPW 312BS, Etc).
U.S. Appl. No. 13/022,490, filed Feb. 7, 2011, Tong.
U.S. Appl. No. 13/358,901, filed Jan. 26, 2012, Progl, et al.
Energy Star® Program Requirements for Integral LED Lamps, amended Mar. 22, 2010.
International Search Report and Written Opinion for PCT Application No. PCT/US2010/003146 dated Jun. 7, 2011.
Decision for Final Rejection for Japanese Patent Application No. 2001-542133 dated Jun. 28, 2011.
Examination from European Patent Appl. No. 10799139. 0, dated Nov. 18, 2015.
Request for Correction from Chinese Patent Appl. No. 201180022606X, dated Nov. 12, 2015.
Third Office Action from Chinese Patent Appl. No. 2011800223856, dated Nov. 2, 2015.
Office Action from U.S. Appl. No. 13/536,707, dated Nov. 16, 2015.
Office Action from U.S. Appl. No. 14/185,123, dated Nov. 17, 2015.
Office Action from U.S. Appl. No. 13/029,068, dated Dec. 3, 2015.
Office Action from U.S. Appl. No. 14/453,482, dated Oct. 1, 2015.
Office Action from U.S. Appl. No. 14/108,815, dated Nov. 5, 2015.
Third Office Action from Chinese Patent Appl. No. 2011800207092, dated Jul. 13. 2015.
Notice of Allowance from Japanese Patent Appl. No. 2014-122643, dated Sep. 3, 2015.
Notification of the Fourth Office Action from Chinese Patent Appl. No. 2011800207069, dated Aug. 24, 2015.
Decision of Rejection from Japanese Patent Appl. No. 2012-566065, dated Aug. 18, 2015.
Second Office Action from Chinese Patent Appl. No. 2011800226267, dated Aug. 3, 2015.
Office Action from U.S. Appl. No. 13/029,025, dated Aug. 17, 2015.
Office Action from U.S. Appl. No. 13/430,478, dated Aug. 27, 2015.
Office Action from U.S. Appl. No. 12/985,275, dated Sep. 2, 2015.
Office Action from U.S. Appl. No. 13/029,068, dated Sep. 8, 2015.
Office Action from U.S. Appl. No. 13/029,063, dated Sep. 17, 2015.
Office Action from U.S. Appl. No. 11/149,999, dated Oct. 1, 2015.
Second Office Action from Chinese Patent Appl. No. 2011800223856, dated Apr. 16, 2015.
Office Action from Taiwanese Patent Appl. No. 100107048, dated Apr. 24, 2015.
Notice of Decline of Amendments and Final Office Action from Japanese Appl. No. 2012-556065, dated Apr. 10, 2015.
Second Office Action from Chinese Patent Appl. No. 2011800223837, dated Apr. 13, 2015.
Communication from European Patent Appl. No. 13762957 .2-1757, dated Apr. 30, 2015.
Office Action and Search Report from Taiwanese Patent Appl. No. 100107051, dated May 12, 2015.
Third Office Action from Chinese Patent Appl. No. 2011800207069. dated Apr. 13, 2015.
Second Office Action from Chinese Patent Appl. No. 2011800226248, dated May 4, 2015.
Office Action from Taiwanese Appl. No. 100107047, dated Jun. 5, 2015.
Second Office Action from Chinese Appl. No. 201180022620X. dated Apr. 20, 2015.
Office Action from Taiwanese Appl. No. 100107040, dated Jun. 5, 2015.
Office Action from Taiwanese Patent Appl. No. 10420724800, dated Jun. 2, 2015.
Office Action from U.S. Appl. No. 13/029,068, dated Mar. 31, 2015.
Office Action from U.S. Appl. No. 11/149,999, dated Mar. 31, 2015.
Office Action from U.S. Appl. No. 12/985,275, dated Apr. 3, 2015.
Office Action from U.S. Appl. No. 13/430,478, dated Apr. 22, 2015.
Office Action from U.S. Appl. No. 13/029,025, dated Apr. 29, 2015.
Office Action from U.S. Appl. No. 13/018,245, dated May 28, 2015.
Office Action from U.S. Appl. No. 13/028,863, dated Jun. 3, 2015.
Office Action from U.S. Appl. No. 14/185,123, dated Jun. 9, 2015.
Search Report and Office Action from Taiwanese Patent Appl. No. 099143827, dated Jun. 12, 2015.
Office Action from Taiwanese Patent Appl. No. 100107012, dated Jul. 22, 2015.
Decision of Board of Appeal and Minutes of Oral Proceedings from European Appl. No. 09152962, dated Jun. 2, 2015.
Decision to Grant from Chinese Patent Appl. No. 201080062056.X, dated Jul. 6, 2015.
Office Action from Taiwanese Appl. No. 101107038, dated Jul. 21, 2015.
Office Action from Taiwanese Patent Appl. No. 100107042, dated Jun. 2, 2015.
Office Action from Taiwanese Patent Appl. No. 100107047, dated Jun. 2, 2015.
Office Action from Taiwanese Patent Appl. No. 100107040, dated Jun. 2, 2015.

(56) References Cited

OTHER PUBLICATIONS

Office Action from Taiwanese Patent Appl. No. 100107044, dated Jun. 1, 2015.
Third Office Action from Chinese Patent Appl. No. 201180022606X, dated Jun. 10, 2015.
Third Office Action from Chinese Patent Appl. No. 2011800223856—translations only, original already submitted.
Official Notification and Search Report from Taiwanese Patent appl. No. 10421609300, dated Dec. 1, 2015.
Official Notification and Search Report from Taiwanese Patent appl. No. 10421621560, dated Dec. 2, 2015.
Third Office Action from Chinese Patent Appl. No. 2011800226248, dated Nov. 20, 2015.
Official Notification and Search Report from Taiwanese Patent appl. No. 10421651990, dated Dec. 7, 2015.
Notice of Issuance from Chinese Patent Appl. No. 2011800226063X, dated Dec. 10, 2015.
Official Notification and Search Report from Taiwanese Patent Appl. No. 10421595210, dated Nov. 27, 2015.
Office Action from Chinese Patent Appl. No. 201180022583.2, dated Dec. 17, 2015.
Examination from European Patent appl. No. 11 710 906.6-1757, dated Jan. 8, 2016.
Examination from European Patent appl. No. 11 710 348.1-1757, dated Jan. 8, 2016.
Office Action from U.S. Appl. No. 13/029,025; dated Jan. 6, 2016.
Office Action from U.S. Appl. No. 13/430,478; dated Jan. 7, 2016.
Office Action from U.S. Appl. No. 13/029,063; dated Feb. 11, 2016.
Fourth Office Action from Chinese Patent Appl. No. 201180020709.2, dated Jan. 25, 2016.
Decision of Rejection from Chinese Patent Appl. No. 201180020706.9. dated Mar. 2, 2016.
Re-Examination Report from Japanese Patent Appl. No. 2012-556065. dated Feb. 1, 2016.
Examination Report from European Patent Appl. No. 11 709 509.1-1757. dated Mar. 4, 2016.
Office Action from U.S. Appl. No. 12/985,275; dated Feb. 18, 2016.
Office Action from U.S. Appl. No. 14/453,482: dated Apr. 1, 2016.
Office Action from Japanese Patent Appl. No. 2014-122643, dated Apr. 10, 2015.
Office Action from U.S. Appl. No. 13/029,068, dated Jun. 13, 2014.
Office Action from U.S. Appl. No. 13/018,245, dated Jun. 10, 2014.
Decision to Grant from Japanese Patent Appl. No. 2012-556066, dated Jul. 4, 2014.
Decision of Rejection from Japanese Patent Appl. No. 2012-556064, dated Jun. 6, 2014.
First Office Action from Chinese Appl. No. 201180022626.7. dated Nov. 15, 2014.
Second Office Action from Chinese Appl. No. 201180022606X, dated Dec. 23, 2014.
Appeal Decision from Japanese Appl. No. 2011-231319. dated Jan. 13, 2015.
Office Action from U.S. Appl. No. 13/607,300, dated Nov. 19, 2014.
Office Action from U.S. Appl. No. 13/029,025, dated Dec. 11, 2014.
Office Action from U.S. Appl. No. 13/018,245, dated Dec. 11, 2014.
Office Action from U.S. Appl. No. 13/029,068, dated Dec. 23, 2014.
Office Action from U.S. Appl. No. 12/985,275, dated Dec. 29, 2014.
Third Office Action for Chinese Application No. 2011800226267: dated Apr. 6, 2016.
Office Action from U.S. Appl. No. 14/108,815: dated Apr. 27, 2016.
Fourth Office Action for Chinese Application No. 2011800223856: dated May 5, 2016.
Fourth Office Action for Chinese Application No. 201180022624.8; dated May 24, 2016.
Fourth Office Action for Chinese Application No. 2011800223837: dated Jun. 6, 2016.
Office Action from U.S. Appl. No. 13/029,068: dated Jun. 9, 2016.
Office Action from U.S. Appl. No. 13/536,707: dated Jun. 23, 2016.
Notice of Reasons for Rejection from Japanese Patent Appl. No. 2012-543086, dated Dec. 24, 2013.
Office Action from Japanese Patent Appl. No. 2012-556062, dated Dec. 20, 2013.
International Preliminary Report on Patentability and Written Opinion from PCT/US2012/044705 dated Jan. 7, 2014.
Decision of Rejection for Chinese Appl. 2011800223856; dated Jan. 5, 2017.
Office Action for Chinese Appl. 2011800225832; dated Feb. 4, 2017.
Notice of Reasons for Rejection from Japanese Patent Appl. No. 2012-543086, dated Aug. 27, 2013.
Third Office Action for Chinese Application No. 2011800225832; dated Jul. 7, 2016.
Notice of Issuance for Chinese Application No. 201180020709.2; dated Jul. 25, 2016.
European Office Action for Application No. 11710348.1; dated Aug. 8, 2016.
Office Action for U.S. Appl. No. 12/985,275; dated Aug. 30, 2016.
Office Action for U.S. Appl. No. 13/029,063; dated Sep. 8, 2016.
Office Action for Chinese Application No. 201180022383.7; dated Mar. 15, 2017.
Office Action for European Application No. 15750564.5; dated Mar. 15, 2017.
Office Action for European Application No. 10799139.0; dated Mar. 31, 2017.
Office Action for U.S. Appl. No. 14/108,815; dated Apr. 28, 2017.
Office Action for U.S. Appl. No. 14/453,482; dated Apr. 20, 2017.
Office Action for U.S. Appl. No. 13/029,068; dated Jun. 2, 2017.
Office Action for Japanese Application No. 2012-556065; dated Jun. 16, 2017.
Office Action for Chinese Application No. 201180022620; dated Jun. 26, 2017.
Office Action for U.S. Appl. No. 13/536,707; dated Jun. 30, 2017.
Office Action for U.S. Appl. No. 13/029,063; dated Aug. 2, 2017.
Office Action for U.S. Appl. No. 14/108,815; dated Aug. 4, 2017.
Office Action for U.S. Appl. No. 14/453,482; dated Oct. 19, 2017.
Office Action for Japanese Application No. 2012-556065; dated Oct. 24, 2017.
Office Action for U.S. Appl. No. 13/029,068; dated Nov. 3, 2017.
Office Action for Chinese Application No. 2011800225832; dated Dec. 14, 2017.
Office Action for U.S. Appl. No. 14/108,815; dated Jan. 5, 2018.
Office Action for U.S. Appl. No. 13/029,068; dated Feb. 8, 2018.
Office Action for U.S. Appl. No. 13/536,707; dated Feb. 22, 2018.
Foreign Office Action for Chinese Application No. 201180022583.2; dated Apr. 4, 2018.
Office Action for U.S. Appl. No. 14/453,482; dated May 18, 2018.
Office Action for U.S. Appl. No. 14/108,815; dated May 24, 2018.
Office Action for U.S. Appl. No. 13/029,068; dated Jun. 15, 2018.
Office Action for U.S. Appl. No. 13/536,707; dated Jul. 10, 2018.
Office Action for Chinese Application No. 2015800540943; dated Apr. 28, 2018.
Foreign Notice of Allowance for European Application No. 11710906.6: dated Sep. 2, 2016.
Office Action for U.S. Appl. No. 14/108,815: dated Sep. 16, 2016.
Office Action for U.S. Appl. No. 14/453,482: dated Sep. 22, 2016.
Office Action for U.S. Appl. No. 13/536,707: dated Oct. 19, 2016.
Foreign Office Action for Japanese Appl. No. 2012-556065; dated Nov. 22, 2016.
Foreign Office Action for Chinese Appl. No. 2011800207069: dated Nov. 29, 2016.
Foreign Office Action for Chinese Appl. No. 201180022620: dated Dec. 1, 2016.
Foreign Office Action for Chinese Appl. No. 2011800226267; dated Dec. 15, 2016.
Notice of Allowance for Chinese Application No. 201180022624.8; dated Jan. 3, 2017.
Office Action for U.S. Appl. No. 13/029,068; dated Jan. 10, 2017.

* cited by examiner

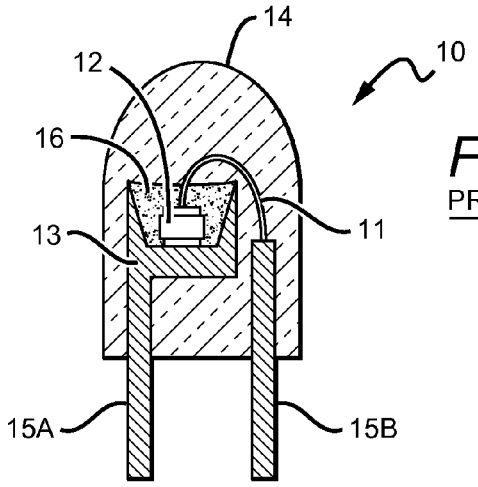
FIG. 1
PRIOR ART
FIG. 2
PRIOR ART
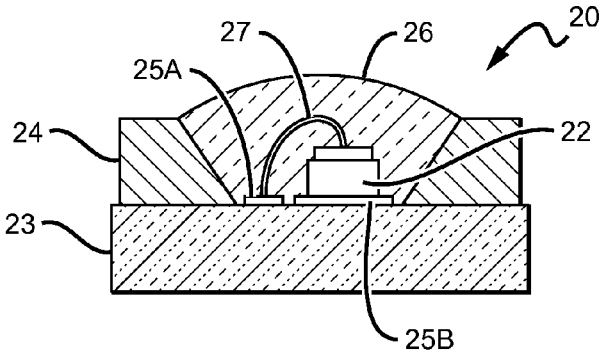
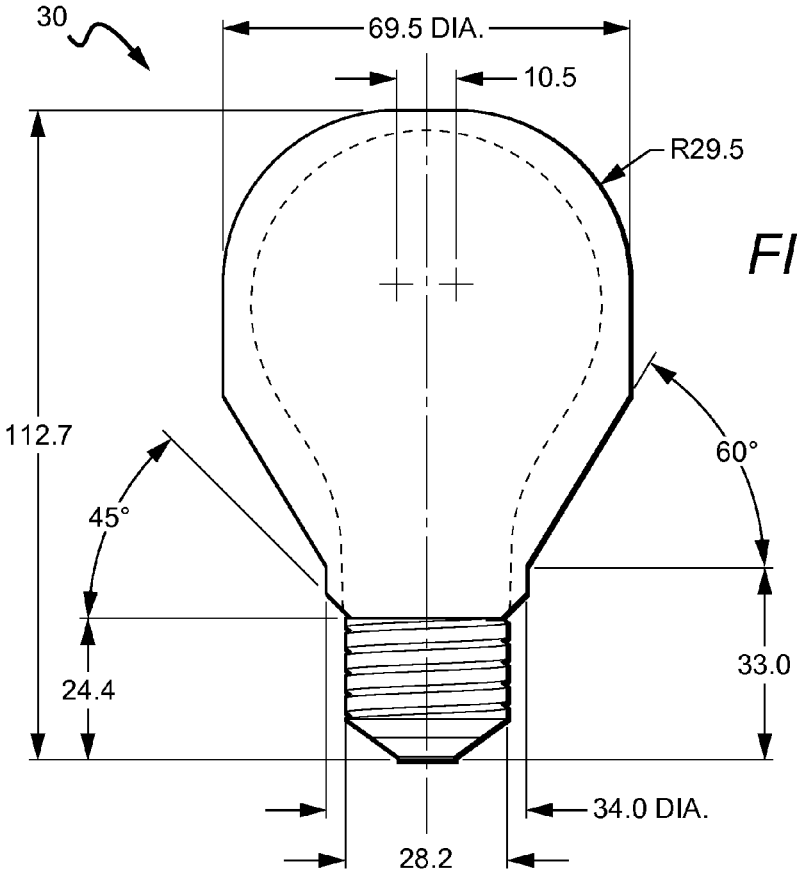
FIG. 3

FIG. 4
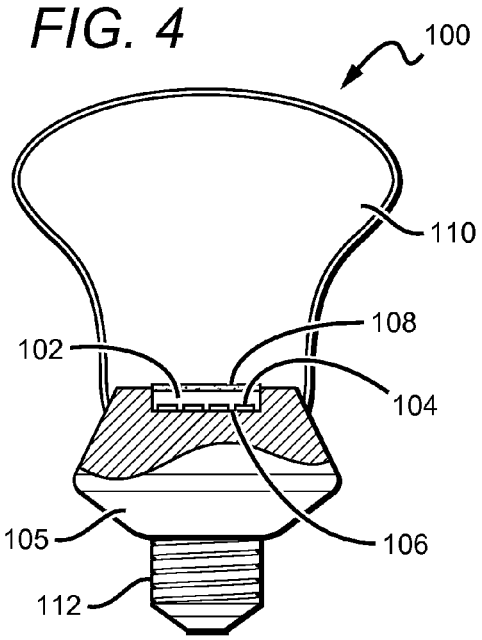
FIG. 5
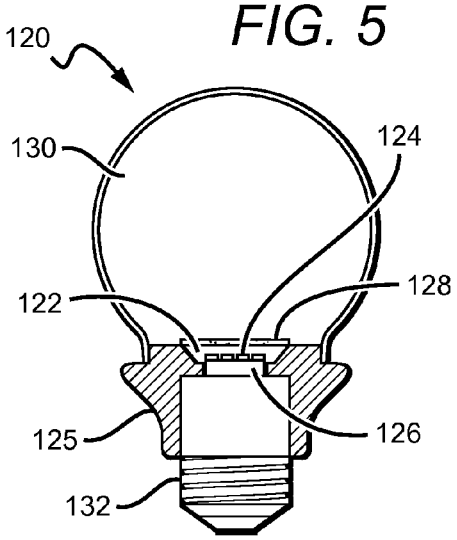
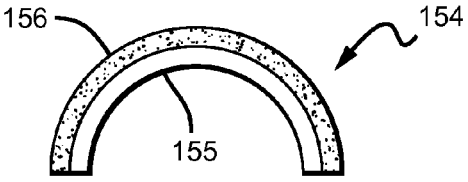
FIG. 6
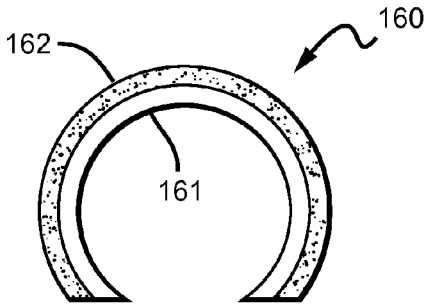
FIG. 8
FIG. 7
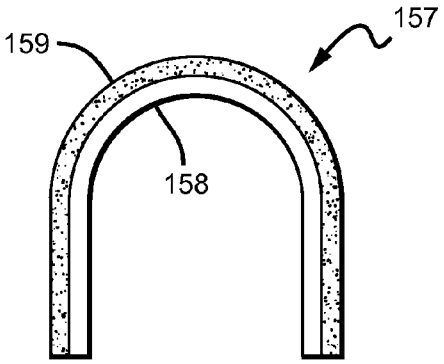
FIG. 9
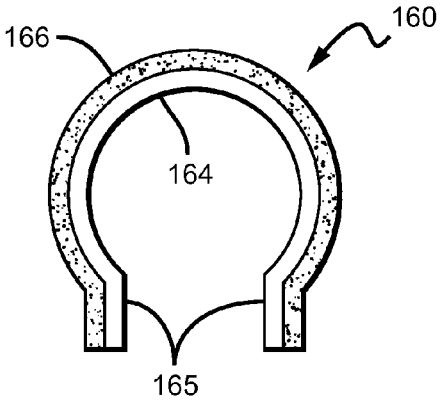

FIG. 22
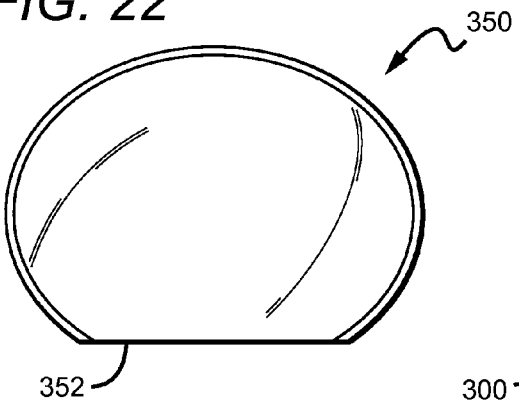
FIG. 23
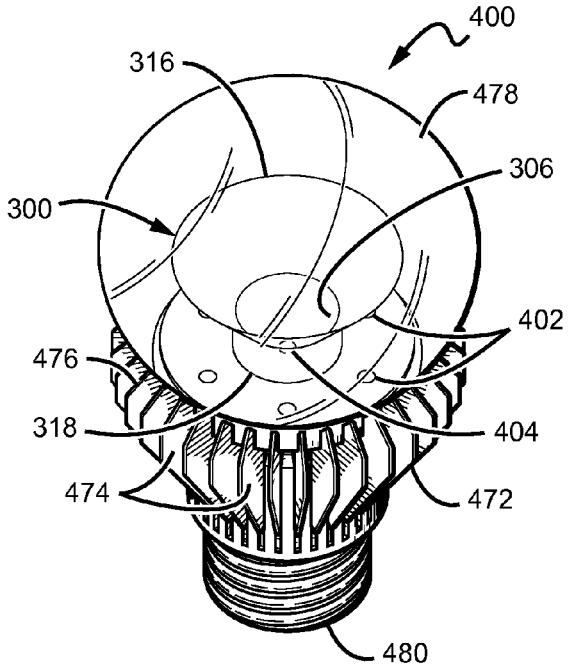
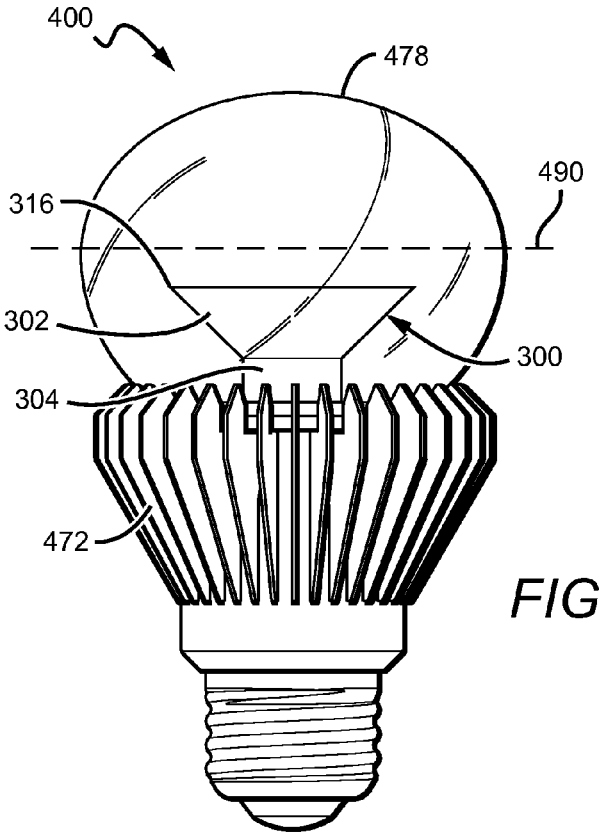
FIG. 24

FIG. 32
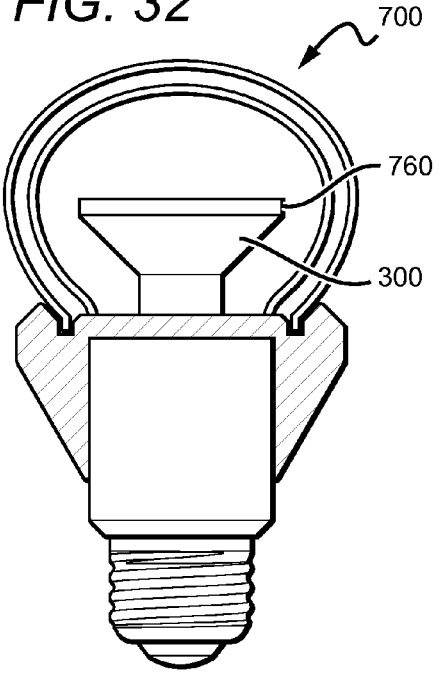
FIG. 33
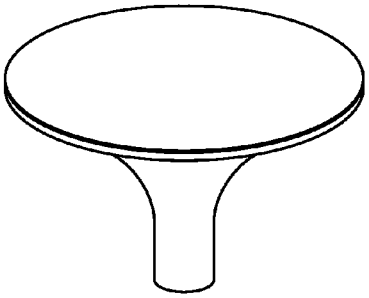
FIG. 34
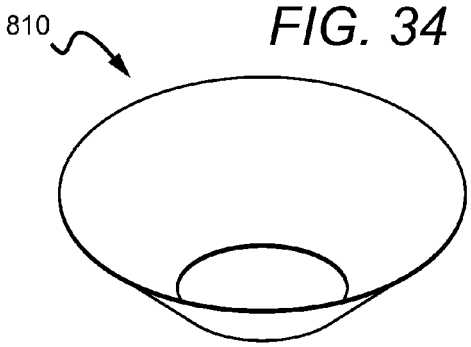
FIG. 35
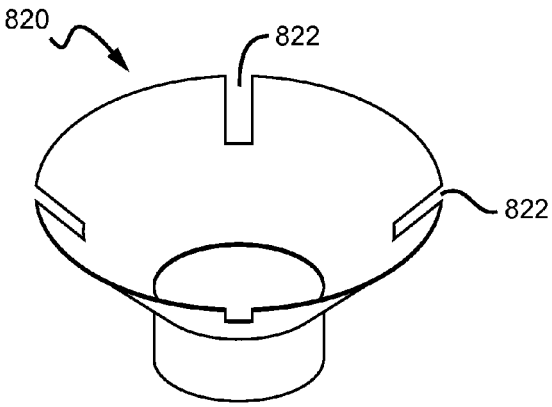
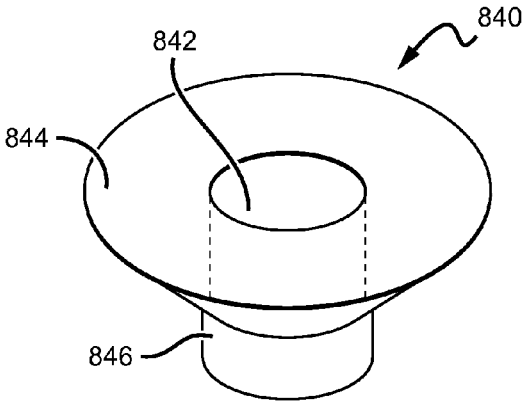
FIG. 36

FIG. 48
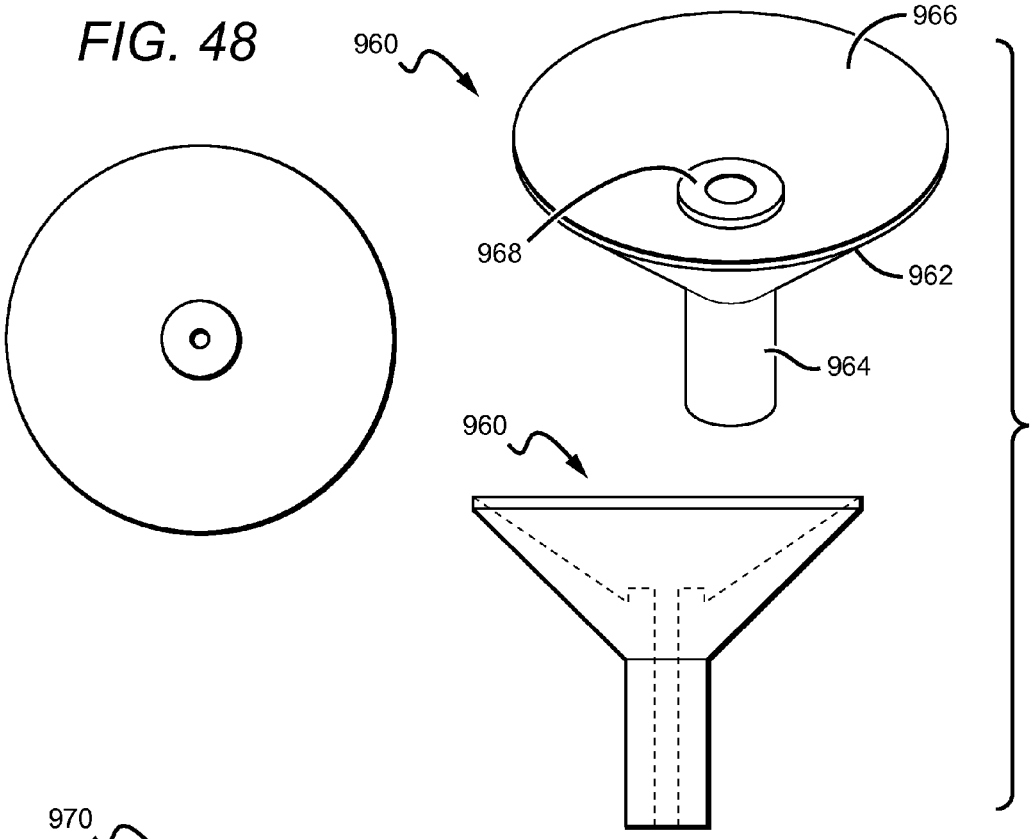
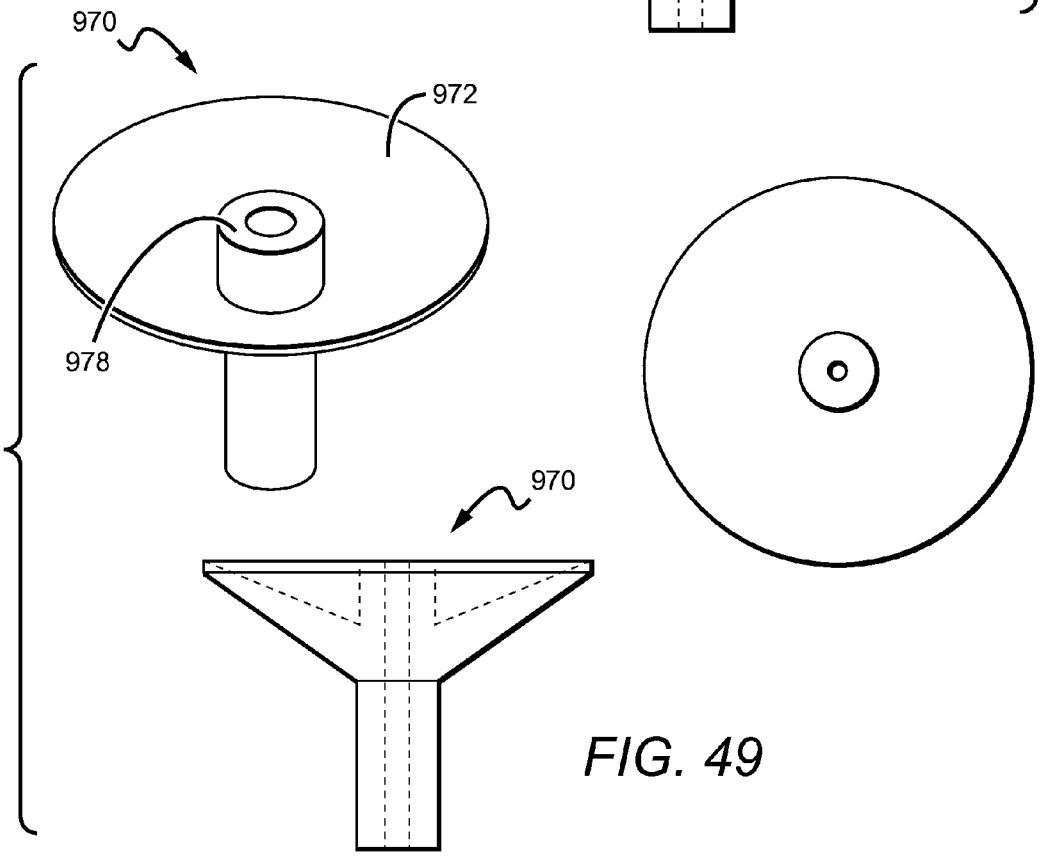
FIG. 49

SOLID STATE LAMP WITH LIGHT DIRECTING OPTICS AND DIFFUSER

This application is a continuation-in-part from, and claims the benefit of, U.S. patent application Ser. No. 12/848,825, filed on Aug. 2, 2010, which claims the benefit of U.S. Provisional Patent Application Ser. No. 61/339,516, filed on Mar. 3, 2010. This application is also a continuation-in-part from, and claims the benefit of, U.S. patent application Ser. No. 13/029,068, filed on Feb. 16, 2011, which claims the benefit of U.S. Provisional Patent Application Ser. No. 61/339,516, filed on Mar. 3, 2010, U.S. Provisional Patent Application Ser. No. 61/339,515, filed on Mar. 3, 2010, U.S. Provisional Patent Application Ser. No. 61/386,437, filed on Sep. 24, 2010, U.S. Provisional Application Ser. No. 61/424,665, filed on Dec. 19, 2010, U.S. Provisional Application Ser. No. 61/424,670, filed on Dec. 19, 2010, U.S. Provisional Patent Application Ser. No. 61/434,355, filed on Jan. 19, 2011, U.S. Provisional Patent Application Ser. No. 61/435,326, filed on Jan. 23, 2011, and U.S. Provisional Patent Application Ser. No. 61/435,759, filed on Jan. 24, 2011, and is also a continuation-in-part from, and claims the benefit of, U.S. patent application Ser. No. 12/848,825, filed on Aug. 2, 2010, U.S. patent application Ser. No. 12/889,719, filed on Sep. 24, 2010, U.S. patent application Ser. No. 12/975,820, filed on Dec. 22, 2010.

BACKGROUND OF THE INVENTION

Field of the Invention

This invention relates to solid state lamps and bulbs and in particular to efficient and reliable light emitting diode (LED) based lamps and bulbs capable of producing omni-directional emission patterns.

Description of the Related Art

Incandescent or filament-based lamps or bulbs are commonly used as light sources for both residential and commercial facilities. However, such lamps are highly inefficient light sources, with as much as 95% of the input energy lost, primarily in the form of heat or infrared energy. One common alternative to incandescent lamps, so-called compact fluorescent lamps (CFLs), are more effective at converting electricity into light but require the use of toxic materials which, along with its various compounds, can cause both chronic and acute poisoning and can lead to environmental pollution. One solution for improving the efficiency of lamps or bulbs is to use solid state devices such as light emitting diodes (LED or LEDs), rather than metal filaments, to produce light.

Light emitting diodes generally comprise one or more active layers of semiconductor material sandwiched between oppositely doped layers. When a bias is applied across the doped layers, holes and electrons are injected into the active layer where they recombine to generate light. Light is emitted from the active layer and from various surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflective cup due to the less than 100% reflectivity of practical reflector surfaces). In addition, heat retention may be an issue for a package such as the package 10 shown in FIG. 1, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 27 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method," the figures and descriptions of which are hereby fully incorporated by reference herein. Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices," the figures and descriptions of which are hereby fully incorporated by reference herein.

LED chips which have a conversion material in close proximity or as a direct coating have been used in a variety of different packages, but experience some limitations based on the structure of the devices. When the phosphor material is on or in close proximity to the LED epitaxial layers (and in some instances comprises a conformal coat over the LED), the phosphor can be subjected directly to heat generated by the chip which can cause the temperature of the phosphor material to increase. Further, in such cases the phosphor can be subjected to very high concentrations or flux of incident light from the LED. Since the conversion process is in general not 100% efficient, excess heat is produced in the phosphor layer in proportion to the incident light flux. In compact phosphor layers close to the LED chip, this can lead to substantial temperature increases in the phosphor layer as large quantities of heat are generated in small areas. This temperature increase can be exacerbated when phosphor particles are embedded in low thermal conductivity material such as silicone which does not provide an effective dissipation path for the heat generated within the phosphor particles. Such elevated operating temperatures can cause degradation of the phosphor and surrounding materials over time, as well as a reduction in phosphor conversion efficiency and a shift in conversion color.

Lamps have also been developed utilizing solid state light sources, such as LEDs, in combination with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light to a different wavelength through a phosphor or other conversion material. In some embodiments the separator spaces the light source a sufficient distance from the disperser such that heat from the light source will not transfer to the disperser when the light source is carrying elevated currents necessary for room illumination. Additional remote phosphor techniques are described in U.S. Pat. No. 7,614,759 to Negley et al., entitled "Lighting Device."

One potential disadvantage of lamps incorporating remote phosphors is that they can have undesirable visual or aesthetic characteristics. When the lamps are not generating light the lamp can have a surface color that is different from the typical white or clear appearance of the standard Edison bulb. In some instances the lamp can have a yellow or orange appearance, primarily resulting from the phosphor conversion material, such as yellow/green and red phosphors. This appearance can be considered undesirable for many applications where it can cause aesthetic issues with the surrounding architectural elements when the light is not illuminated. This can have a negative impact on the overall consumer acceptance of these types of lamps.

Further, compared to conformal or adjacent phosphor arrangements where heat generated in the phosphor layer during the conversion process may be conducted or dissipated via the nearby chip or substrate surfaces, remote phosphor arrangements can be subject to inadequate thermally conductive heat dissipation paths. Without an effective heat dissipation pathway, thermally isolated remote phosphors may suffer from elevated operating temperatures that in some instances can be even higher than the temperature in comparable conformal coated layers. This can offset some or all of the benefit achieved by placing the phosphor remotely with respect to the chip. Stated differently, remote phosphor placement relative to the LED chip can reduce or eliminate direct heating of the phosphor layer due to heat generated within the LED chip during operation, but the resulting phosphor temperature decrease may be offset in part or entirely due to heat generated in the phosphor layer itself during the light conversion process and lack of a suitable thermal path to dissipate this generated heat.

Another issue affecting the implementation and acceptance of lamps utilizing solid state light sources relates to the nature of the light emitted by the light source itself. In order to fabricate efficient lamps or bulbs based on LED light sources (and associated conversion layers), it is typically desirable to place the LED chips or packages in a co-planar arrangement. This facilitates manufacture and can reduce manufacturing costs by allowing the use of conventional production equipment and processes. However, co-planar arrangements of LED chips typically produce a forward directed light intensity profile (e.g., a Lambertian profile). Such beam profiles are generally not desired in applications where the solid-state lamp or bulb is intended to replace a conventional lamp such as a traditional incandescent bulb, which has a much more omni-directional beam pattern. While it is possible to mount the LED light sources or packages in a three-dimensional arrangement, such arrangements are generally difficult and expensive to fabricate.

SUMMARY OF THE INVENTION

The present invention provides lamps and bulbs generally comprising different combinations and arrangement of a light source, one or more wavelength conversion materials, regions or layers which are positioned separately or remotely with respect to the light source, and a separate diffusing layer. This arrangement allows for the fabrication of lamps and bulbs that are efficient, reliable and cost effective and can provide an essentially omni-directional emission pattern, even with a light source comprised of a co-planar arrangement of LEDs. The lamps according to the present invention can also comprise thermal management features that provide for efficient dissipation of heat from the LEDs, which in turn allows the LEDs to operate at lower temperatures. The lamps can also comprise optical elements to help change the emission pattern from the generally directional (e.g. Lambertian) pattern of the LEDs to a more omnidirectional pattern.

One embodiment of a solid state lamp according to the present invention comprises an LED and an optical element over said LED such that light from the LED interacts with the optical element. The optical element changes the emission pattern of the LED to a broader emission pattern. The lamp also comprises a phosphor carrier over the optical element, with the phosphor carrier converting at least some of the LED light to a different wavelength.

Another embodiment of a solid state lamp according to the present invention comprises a heat dissipation element with a dielectric layer on the heat dissipation element. A heat spreading substrate is included on the dielectric layer, and an LED is included on and in thermal contact with the heat spreading substrate. The heat spreading substrate is arranged to spread heat from the LED prior to the LED heat reaching the dielectric layer.

Still another embodiment of a solid state lamp according to the present invention comprises an array of solid state emitters emitting light in a substantially directional emission pattern. A three-dimensional optical element is included over the array of solid state light emitters, the optical element modifying the directional emission pattern of the array of solid state light emitters to a more omni-directional emission pattern. A portion of light from the solid state light emitters provides forward light emission for the lamp emission pattern.

Still another embodiment of a solid state lamp according to the present invention comprises an LED and a reflective optical element over said LED such that light from the LED interacts with the optical element. The optical element changes the emission pattern of the LED to a broader emission pattern.

One embodiment of an optical element according to the present invention is three-dimensional and designed for use in a solid state lamp. The optical element has a reflective outer surface and a cavity for housing one or more solid state emitters.

These and other aspects and advantages of the invention will become apparent from the following detailed description and the accompanying drawings which illustrate by way of example the features of the invention.

BRIEF DESCRIPTION OF THE DRAWINGS

FIG. 1 shows a sectional view of one embodiment of a prior art LED lamp;

FIG. 2 shows a sectional view of another embodiment of a prior art LED lamp;

FIG. 3 shows the size specifications for an A19 replacement bulb;

FIG. 4 is a sectional view of one embodiment of a lamp according to the present invention;

FIG. 5 is a sectional view of one embodiment of a lamp according to the present invention;

FIG. 6-9 are sectional views of different embodiments of a phosphor carrier according to the present invention;

FIG. 22 is a cross sectional view of a diffuser according to the present invention;

FIG. 23 is a perspective view of another embodiment of a lamp according to the present invention;

FIG. 24 is a side view of the lamp shown in FIG. 23;

FIG. 32 is a cross sectional view of the lamp shown in FIG. 31.

FIG. 33 is a perspective view of another embodiment of an optical element according to the present invention;

FIG. 34 is a perspective view of another embodiment of an optical element according to the present invention;

FIG. 35 is a perspective view of another embodiment of an optical element according to the present invention;

FIG. 36 is a perspective view of another embodiment of an optical element according to the present invention.

FIG. 48 is a perspective view of another embodiment of an optical element according to the present invention.

FIG. 49 is a perspective view of another embodiment of an optical element according to the present invention.

DETAILED DESCRIPTION OF THE INVENTION

Figure 10:
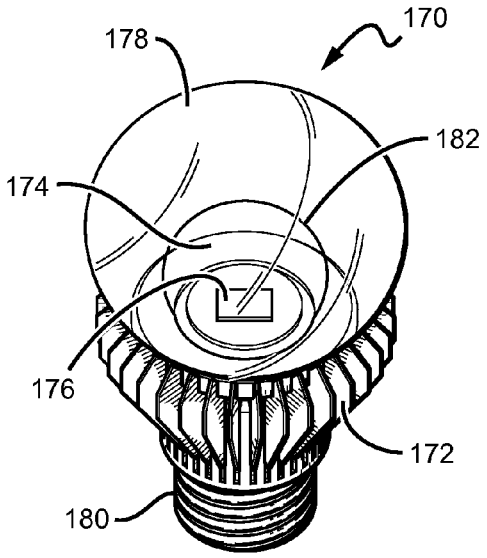
FIG. 10 is a perspective view of one embodiment of a lamp according to the present invention.

The present invention is directed to different embodiments of lamp or bulb structures that are efficient, reliable and cost effective, and that in some embodiments can provide an essentially omnidirectional emission pattern from directional emitting light sources, such as forward emitting light sources. The present invention is also directed to lamp structures using solid state emitters with remote conversion materials (or phosphors) and remote diffusing elements or diffusers. In some embodiments, the diffuser not only serves to mask the phosphor from the view by the lamp user, but can also disperse or redistribute the light from the remote phosphor and/or the lamp's light source into a desired emission pattern. In some embodiments the diffuser dome can be arranged to disperse forward directed emission pattern into a more omnidirectional pattern useful for general lighting applications. The diffuser can be used in embodiments having two-dimensional as well as three-dimensional shaped remote conversion materials, with a combination of features capable of transforming forward directed emission from an LED light source into a beam profile comparable with standard incandescent bulbs.

The present invention is described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

Some embodiments of lamps can have a dome-shaped (or frusto-spherical shaped) three dimensional conversion material over and spaced apart from the light source, and a dome-shaped diffuser spaced apart from and over the conversion material, such that the lamp exhibits a double-dome structure. The spaces between the various structure can comprise light mixing chambers that can promote not only dispersion of, but also color uniformity of the lamp emission. The space between the light source and conversion material, as well as the space between the conversion material, can serve as light mixing chambers. Other embodiments can comprise additional conversion materials or diffusers that can form additional mixing chambers. The order of the dome conversion materials and dome shaped diffusers can be different such that some embodiments can have a diffuser inside a conversion material, with the spaces between forming light mixing chambers. These are only a few of the many different conversion materials and diffuser arrangement according to the present invention.

Some lamp embodiments according to the present invention can comprise a light source having a co-planar arrangement of one or more LED chips or packages, with the emitters being mounted on a flat or planar surface. In other embodiments, the LED chips can be non co-planar, such as being on a pedestal or other three-dimensional structure. Co-planar light sources can reduce the complexity of the emitter arrangement, making them both easier and cheaper to manufacture. Co-planar light sources, however, tend to emit primarily in the forward direction such as in a Lambertian emission pattern. In different embodiments it can be desirable to emit a light pattern mimicking that of conventional incandescent light bulbs that can provide a nearly uniform emission intensity and color uniformity at different emission angles. Different embodiments of the present invention can comprise features that can transform the emission pattern from the non-uniform to substantially uniform within a range of viewing angles.

Different embodiments of the lamps can have many different shapes and sizes, with some embodiments having dimensions to fit into standard size envelopes, such as the A19 size envelope 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23. The lamp having high efficiency and low manufacturing cost.

The present invention comprises an efficient heat dissipation system that serves to laterally spread heat from the LED chips prior to encountering any dielectric layers. This allows the LEDs to operate at lower temperatures. Some embodiments of a thermally efficient heat dissipation system can comprise many different elements arranged in many different ways. Some embodiments comprise a heat-spreading substrate with high thermal conductivity that serves to laterally spread heat from the LED chips prior to encountering any dielectric layers. The heat dissipation system can also comprise a dielectric layer mounted on a heat dissipation element such as a heat sink or heat pipe. By spreading the LED heat prior to encountering the dielectric layer, the impact of the dielectric layer's thermal resistance is minimized.

An optical element can be included that efficiently guides or reflects light from multiple co-planar LED chips, into a specified beam profile with minimal light loss. The lamps according to the present invention can comprise one or more remotely located phosphors and/or diffusers that can be included over the optical elements with the phosphor carrier converting at least part of the light emitted by the LED chip(s) into light of different wavelength. The phosphor carrier can also be arranged so as to minimize heating and saturation of the phosphor grains in the phosphor carrier. A diffuser can also be included over the phosphor carrier to further disperse light into the desired emission pattern.

In some embodiments the light sources can comprise solid state light sources, such as different types of LEDs, LED chips or LED packages. In some embodiments a single LED chip or package can be used, while in others multiple LED chips or packages can be arranged in different types of arrays. By having the phosphor thermally isolated from LED chips and with good thermal dissipation, the LED chips can be driven by higher current levels without causing detrimental effects to the conversion efficiency of the phosphor and its long term reliability. This can allow for the flexibility to overdrive the LED chips to lower the number of LEDs needed to produce the desired luminous flux. This in turn can reduce the cost on complexity of the lamps. These LED packages can comprise LEDs encapsulated with a material that can withstand the elevated luminous flux or can comprise unencapsulated LEDs.

The present invention is also directed to lamp structures which comprise one or more optical elements and one or more remote diffusing elements or diffusers. In some embodiments, the LED chips or packages used in the lamp emit white light, and as such no remote phosphor is necessary. In some embodiments these chips or packages have an emission pattern that is broader than the standard Lambertian pattern. In some embodiments the optical element is reflective and is centered on a carrier such as a submount, and in some embodiments the optical element has a cavity to accommodate the placement of one or more light emitting elements such as LEDs. In addition, some embodiments have a ring of LEDs on the carrier surrounding the optical element. The optical element, the diffuser, or the combination of the two can then shape the forward-emitted light from the LEDs into a more omnidirectional pattern.

While in some embodiments the optical element is shaped such that it is over one or more of the LEDs, these LEDs can still contribute to the forward emission of the lamp (along with, if present, a chip or package in an optical element cavity that is forward-facing). In some embodiments this is achieved by reflecting light emitted from these LEDs off of the reflective element and toward the diffuser; the diffuser then re-reflects or scatters this light such that some of the light contributes to the forward emission of the lamp. In embodiments that do not use white emitting chips or packages, a remote phosphor can also be included, such as a remote phosphor on the diffuser, on a heat sink and over the optical element, or over the optical element cavity.

The present invention is described herein with reference to certain embodiments, but it is understood that the invention can be embodied in many different forms and should not be construed as limited to the embodiments set forth herein. In particular, the present invention is described below in regards to certain lamps having one or multiple LEDs or LED chips or LED packages in different configurations, but it is understood that the present invention can be used for many other lamps having many different configurations. Examples of different lamps arranged in different ways according to the present invention are described below and in U.S. Provisional Patent application Ser. No. 61/435,759, to Le et al., entitled "Solid State Lamp", filed on Jan. 24, 2011, and incorporated herein by reference.

The embodiments below are described with reference to LED of LEDs, but it is understood that this is meant to encompass LED chips and LED packages. The components can have different shapes and sizes beyond those shown and different numbers of LEDs can be included. It is also understood that the embodiments described below are utilize co-planar light sources, but it is understood that non co-planar light sources can also be used. It is also understood that the lamp's LED light source may be comprised of one or multiple LEDs, and in embodiments with more than one LED, the LEDs may have different emission wavelengths. Similarly, some LEDs may have adjacent or contacting phosphor layers or regions, while others may have either adjacent phosphor layers of different composition or no phosphor layer at all.

The present invention is described herein with reference to conversion materials, phosphor layers and phosphor carriers and diffusers being remote to one another. Remote in this context refers being spaced apart from and/or to not being on or in direct thermal contact.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

The different embodiments of the present invention described herein can be used as a basis for the manufacture and production of efficient, low cost LED-based solid state lamps. One example that can be enabled by the present invention can be the large scale replacement of conventional tungsten based omni-directional light bulbs (also known as "A-lamps") with more efficient, longer lasting LED based lamps or bulbs. The general concept and innovations described herein can also be applied to the replacement of a variety of similar tungsten/halogen based lamps or bulbs with corresponding LED based lamps or bulbs.

The present invention is also directed to particular independent LED lamp related devices such as LED substrates and optical elements. These can be provided to lamp designers and manufactures to incorporate into many different lamp or bulb designs beyond those described herein, with those lamps or bulbs operating pursuant to the innovations described herein. Combinations of the different inventive features could also be provided as "light engines" that can be utilized in different lighting designs. For example, a compact, single chip lamp incorporating an LED, heat spreading substrate, optional optical element, optional dielectric layer, and remote phosphor carrier could be provided as a unit to be incorporated into other lighting designs, all of which would operate pursuant to the innovations described herein.

FIG. 4 shows an embodiment of lamp 100 according to the present invention that comprises an optical cavity 102 within a heat sink structure 105. Like the embodiments above, the lamp 100 can also be provided without a lamp cavity, with the LEDs mounted on a surface of the heat sink or on a three dimensional or pedestal structures having different shapes. A planar LED based light source 104 is mounted to the platform 106, and a phosphor carrier 108 is mounted to the top opening of the cavity 102, with the phosphor carrier 108 having any of the features of those described above. In the embodiment shown, the phosphor carrier 108 can be in a flat disk shape and comprises a thermally conductive transparent material and a phosphor layer. It can be mounted to the cavity with a thermally conductive material or device as described above. The cavity 102 can have reflective surfaces to enhance the emission efficiency as described above.

Light from the light source 104 passes through the phosphor carrier 108 where a portion of it is converted to a different wavelength of light by the phosphor in the phosphor carrier 108. In one embodiment the light source 104 can comprise blue emitting LEDs and the phosphor carrier 108 can comprise a yellow phosphor as described above that absorbs a portion of the blue light and re-emits yellow light. The lamp 100 emits a white light combination of LED light and yellow phosphor light. Like above, the light source 104 can also comprise many different LEDs emitting different colors of light and the phosphor carrier can comprise other phosphors to generate light with the desired color temperature and rendering.

The lamp 100 also comprises a shaped diffuser dome 110 mounted over the cavity 102 that includes diffusing or scattering particles such as those listed above. The scattering particles can be provided in a curable binder that is formed in the general shape of dome. In the embodiment shown, the dome 110 is mounted to the heat sink structure 105 and has an enlarged portion at the end opposite the heat sink structure 105. Different binder materials can be used as discussed above such as silicones, epoxies, glass, inorganic glass, dielectrics, BOB, polymides, polymers and hybrids thereof. In some embodiments white scattering particles can be used with the dome having a white color that hides the color of the phosphor in the phosphor carrier 108 in the optical cavity. This gives the overall lamp 100 a white appearance that is generally more visually acceptable or appealing to consumers than the color of the phosphor. In one embodiment the diffuser can include white titanium dioxide particles that can give the diffuser dome 110 its overall white appearance.

The diffuser dome 110 can provide the added advantage of distributing the light emitting from the optical cavity in a more uniform pattern. As discussed above, light from the light source in the optical cavity can be emitted in a generally Lambertian pattern and the shape of the dome 110 along with the scattering properties of the scattering particles causes light to emit from the dome in a more omnidirectional emission pattern. An engineered dome can have scattering particles in different concentrations in different regions or can be shaped to a specific emission pattern. In some embodiments, including those described below, the dome can be engineered so that the emission pattern from the lamp complies with the Department of Energy (DOE) Energy Star defined omnidirectional distribution criteria. One requirement of this standard met by the lamps herein is that the emission uniformity must be within 20% of mean value from 0 to 133° viewing and; >5% of total flux from the lamp must be emitted in the 135-180° emission zone, with the measurements taken at 0, 45, 90° azimuthal angles. As mentioned above, the different lamp embodiments described herein can also comprise A-type retrofit LED bulbs that meet the DOE Energy Star® standards. The present invention provides lamps that are efficient, reliable and cost effective. In some embodiments, the entire lamp can comprise five components that can be quickly and easily assembled.

Like the embodiments above, the lamp 100 can comprise a mounting mechanism 112 of the type to fit in conventional electrical receptacles. In the embodiment shown, the lamp 100 includes a screw-threaded portion 112 for mounting to a standard Edison socket. Like the embodiments above, the lamp 100 can include standard plug and the electrical receptacle can be a standard outlet, or can comprise a GU24 base unit, or it can be a clip and the electrical receptacle can be a receptacle which receives and retains the clip (e.g., as used in many fluorescent lights).

As mentioned above, the space between some of the features of the lamp 100 can be considered mixing chambers, with the space between the light source 106 and the phosphor carrier 108 comprising a first light mixing chamber. The space between the phosphor carrier 108 and the diffuser 110 can comprise a second light mixing chamber, with the mixing chamber promoting uniform color and intensity emission for the lamp. The same can apply to the embodiments below having different shaped phosphor carriers and diffusers. In other embodiments, additional diffusers and/or phosphor carriers can be included forming additional mixing chambers, and the diffusers and/or phosphor carriers can be arranged in different orders.

Different lamp embodiments according to the present invention can have many different shapes and sizes. FIG. 5 shows another embodiment of a lamp 120 according to the present invention that is similar to the lamp 100 and similarly comprises an optical cavity 122 in a heat sink structure 125 with a light source 124 mounted to the platform 126 in the optical cavity 122. Like above, the heat sink structure need not have an optical cavity, and the light sources can be provided on other structures beyond a heat sink structure. These can include planar surfaces or pedestals having the light source. A phosphor carrier 128 is mounted over the cavity opening with a thermal connection. The lamp 120 also comprises a diffuser dome 130 mounted to the heat sink structure 125, over the optical cavity. The diffuser dome can be made of the same materials as diffuser dome 110 described above, but in this embodiment the dome 130 is oval or egg shaped to provide a different lamp emission pattern while still masking the color from the phosphor in the phosphor carrier 128. It is also noted that the heat sink structure 125 and the platform 126 are thermally de-coupled. That is, there is a space between the platform 126 and the heat sink structure such that they do not share a thermal path for dissipating heat. As mentioned above, this can provide improved heat dissipation from the phosphor carrier compared to lamps not having de-coupled heat paths. The lamp 120 also comprises a screw-threaded portion 132 for mounting to an Edison socket.

In the embodiments above, the phosphor carriers are two dimensional (or flat/planar) with the LEDs in the light source being co-planer. It is understood, however, that in other lamp embodiments the phosphor carriers can take many different shapes including different three-dimensional shapes. The term three-dimensional is meant to mean any shape other than planar as shown in the above embodiments. FIGS. 6 through 9 show different embodiments of three-dimensional phosphor carriers according to the present invention, but it is understood that they can also take many other shapes. As discussed above, when the phosphor absorbs and re-emits light, it is re-emitted in an isotropic fashion, such that the 3-dimensional phosphor carrier serves to convert and also disperse light from the light source. Like the diffusers described above, the different shapes of the 3-dimensional carrier layers can emit light in emission patterns having different characteristics that depends partially on the emission pattern of the light source. The diffuser can then be matched with the emission of the phosphor carrier to provide the desired lamp emission pattern.

FIG. 6 shows a hemispheric shaped phosphor carrier 154 comprising a hemispheric carrier 155 and phosphor layer 156. The hemispheric carrier 155 can be made of the same materials as the carrier layers described above, and the phosphor layer can be made of the same materials as the phosphor layer described above, and scattering particles can be included in the carrier and phosphor layer as described above.

In this embodiment the phosphor layer 156 is shown on the outside surface of the carrier 155 although it is understood that the phosphor layer can be on the carrier's inside layer, mixed in with the carrier, or any combination of the three. In some embodiments, having the phosphor layer on the outside surface may minimize emission losses. When emitter light is absorbed by the phosphor layer 156 it is emitted omnidirectionally and some of the light can emit backwards and be absorbed by the lamp elements such as the LEDs. The phosphor layer 156 can also have an index of refraction that is different from the hemispheric carrier 355 such that light emitting forward from the phosphor layer can be reflected back from the inside surface of the carrier 355. This light can also be lost due to absorption by the lamp elements. With the phosphor layer 156 on the outside surface of the carrier 155, light emitted forward does not need to pass through the carrier 155 and will not be lost to reflection. Light that is emitted back will encounter the top of the carrier where at least some of it will reflect back. This arrangement results in a reduction of light from the phosphor layer 156 that emits back into the carrier where it can be absorbed.

The phosphor layer 156 can be deposited using many of the same methods described above. In some instances the three-dimensional shape of the carrier 155 may require additional steps or other processes to provide the necessary coverage. In the embodiments where a solvent-phosphor-binder mixture is sprayed and the carrier can be heated as described above and multiple spray nozzles may be needed to provide the desired coverage over the carrier, such as approximate uniform coverage. In other embodiments, fewer spray nozzles can be used while spinning the carrier to provide the desired coverage. Like above, the heat from the carrier 155 can evaporate the solvent and helps cure the binder.

In still other embodiments, the phosphor layer can be formed through an emersion process whereby the phosphor layer can be formed on the inside or outside surface of the carrier 155, but is particularly applicable to forming on the inside surface. The carrier 155 can be at least partially filled with, or otherwise brought into contact with, a phosphor mixture that adheres to the surface of the carrier. The mixture can then be drained from the carrier leaving behind a layer of the phosphor mixture on the surface, which can then be cured. In one embodiment, the mixture can comprise polyethylen oxide (PEO) and a phosphor. The carrier can be filled and then drained, leaving behind a layer of the PEO-phosphor mixture, which can then be heat cured. The PEO evaporates or is driven off by the heat leaving behind a phosphor layer. In some embodiments, a binder can be applied to further fix the phosphor layer, while in other embodiments the phosphor can remain without a binder.

Like the processes used to coat the planar carrier layer, these processes can be utilized in three-dimensional carriers to apply multiple phosphor layers that can have the same or different phosphor materials. The phosphor layers can also be applied both on the inside and outside of the carrier, and can have different types having different thickness in different regions of the carrier. In still other embodiments different processes can be used such as coating the carrier with a sheet of phosphor material that can be thermally formed to the carrier.

In lamps utilizing the carrier 155, an emitter can be arranged at the base of the carrier so that light from the emitters emits up and passes through the carrier 155. In some embodiments the emitters can emit light in a generally Lambertian pattern, and the carrier can help disperse the light in a more uniform pattern.

FIG. 7 shows another embodiment of a three dimensional phosphor carrier 157 according to the present invention comprising a bullet-shaped carrier 158 and a phosphor layer 159 on the outside surface of the carrier. The carrier 158 and phosphor layer 159 can be formed of the same materials using the same methods as described above. The different shaped phosphor carrier can be used with a different emitter to provide the overall desired lamp emission pattern. FIG. 8 shows still another embodiment of a three dimensional phosphor carrier 160 according to the present invention comprising a globe-shaped carrier 161 and a phosphor layer 162 on the outside surface of the carrier. The carrier 161 and phosphor layer 162 can be formed of the same materials using the same methods as described above.

FIG. 9 shows still another embodiment phosphor carrier 163 according to the present invention having a generally globe shaped carrier 164 with a narrow neck portion 165. Like the embodiments above, the phosphor carrier 163 includes a phosphor layer 166 on the outside surface of the carrier 164 made of the same materials and formed using the same methods as those described above. In some embodiments, phosphor carriers having a shape similar to the carrier 164 can be more efficient in converting emitter light and re-emitting light from a Lambertian pattern from the light source, to a more uniform emission pattern.

Figure 11:
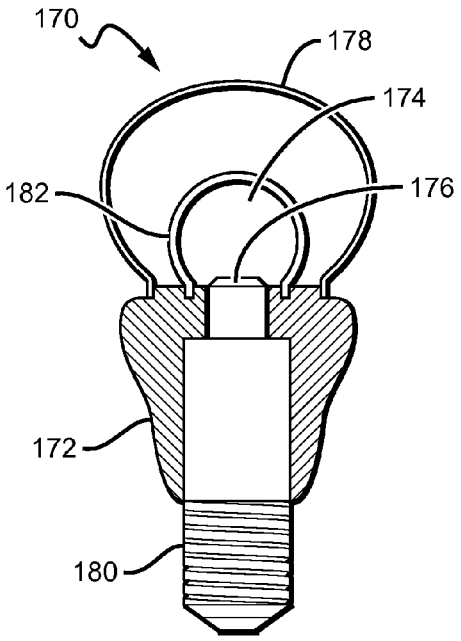
FIG. 11 is a sectional view of the lamp shown in FIG. 10.
Figure 12:
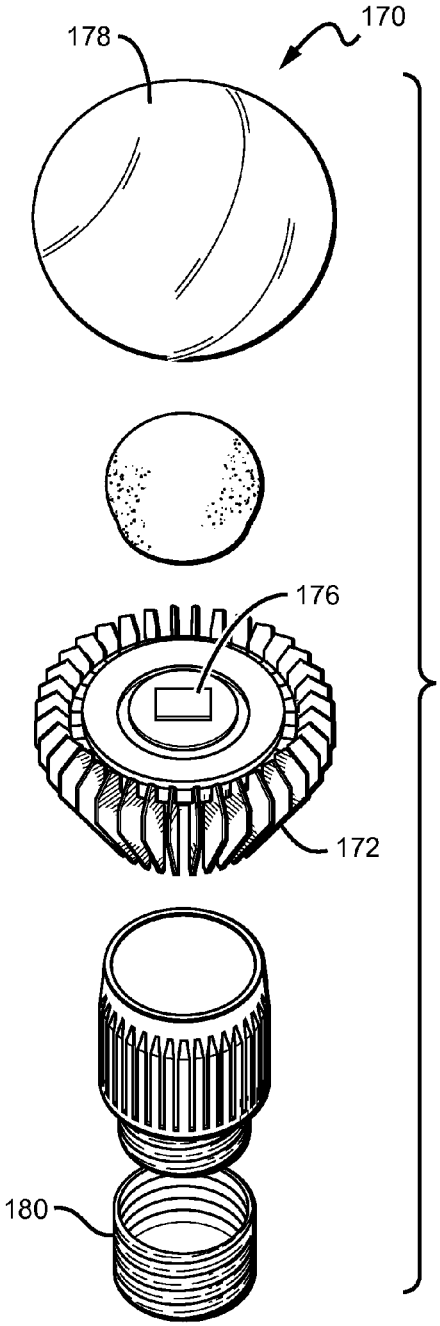
FIG. 12 is an exploded view of the lamp shown in FIG. 10.

FIGS. 10 through 12 show another embodiment of a lamp 170 according to the present invention having a heat sink structure 172, optical cavity 174, light source 176, diffuser dome 178 and a screw-threaded portion 180. This embodiment also comprises a three-dimensional phosphor carrier 182 that includes a thermally conductive transparent material and one phosphor layer. It is also mounted to the heat sink structure 172 with a thermal connection. In this embodiment, however, the phosphor carrier 182 is hemispheric shaped and the emitters are arranged so that light from the light source passes through the phosphor carrier 182 where at least some of it is converted.

The three dimensional shape of the phosphor carrier 182 provides natural separation between it and the light source 176. Accordingly, the light source 176 is not mounted in a recess in the heat sink that forms the optical cavity. Instead, the light source 176 is mounted on the top surface of the heat sink structure 172, with the optical cavity 174 formed by the space between the phosphor carrier 182 and the top of the heat sink structure 172. This arrangement can allow for a less Lambertian emission from the optical cavity 174 because there are no optical cavity side surfaces to block and redirect sideways emission.

In embodiments of the lamp 170 utilizing blue emitting LEDs for the light source 176 and yellow and red phosphor combination in the phosphor carrier. This can cause the phosphor carrier 182 to appear yellow or orange, and the diffuser dome 178 masks this color while dispersing the lamp light into the desired emission pattern. In lamp 170, the conductive paths for the platform and heat sink structure are coupled, but it is understood that in other embodiments they can be de-coupled.

Figure 13:
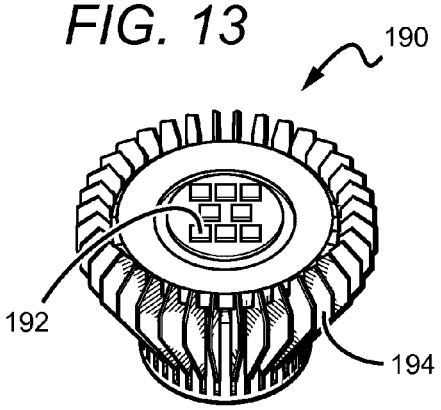
FIG. 13 is a perspective view of one embodiment of a lamp according to the present invention.
Figure 15:
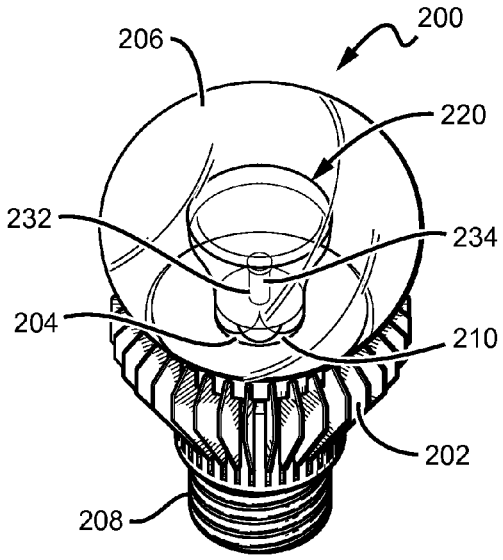
FIG. 15 is a perspective view of another embodiment of a lamp according to the present invention.
Figure 14:
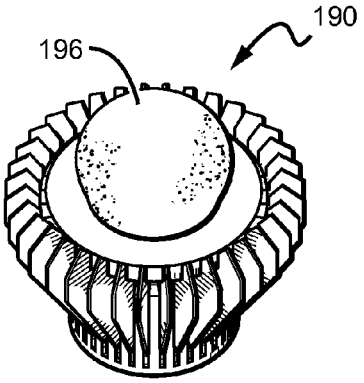
FIG. 14 is a perspective view of the lamp in FIG. 13 with a phosphor carrier.

FIG. 13 shows one embodiment of a lamp 190 according to the present invention comprising a eight LED light source 192 mounted on a heat sink 194 as described above. The emitters can comprise many different types of LEDs that can be coupled together in many different ways and in the embodiment shown are serially connected. In other embodiments, the LEDs can be interconnected in different series and parallel interconnect combinations. It is noted that in this embodiment the emitters are not mounted in a optical cavity, but are instead mounted on top planar surface of the heat sink 194. FIG. 15 shows the lamp 190 shown in FIG. 13 with a dome-shaped phosphor carrier 196 mounted over the light source 192 shown in FIG. 13. The lamp 190 shown in FIG. 14 can be combined with the diffuser 198 as described above to form a lamp with dispersed light emission.

As discussed above, lamps according to the present invention can also comprise thermal dissipation features to allow the LEDs to operate at lower temperatures and optical elements to change the emission pattern of the LEDs chips into a desired emission pattern. In some embodiments that can comprise an substantially omni-directional emission pattern.

Figure 16:
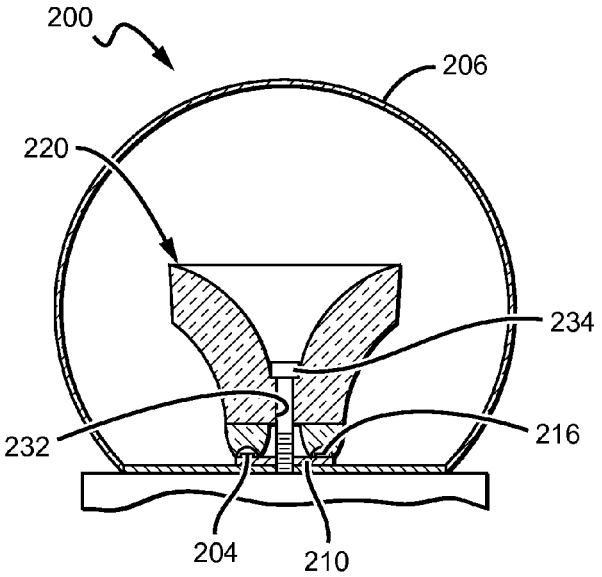
FIG. 16 is a sectional view of the top portion of the lamp shown in FIG. 15.
Figure 17:
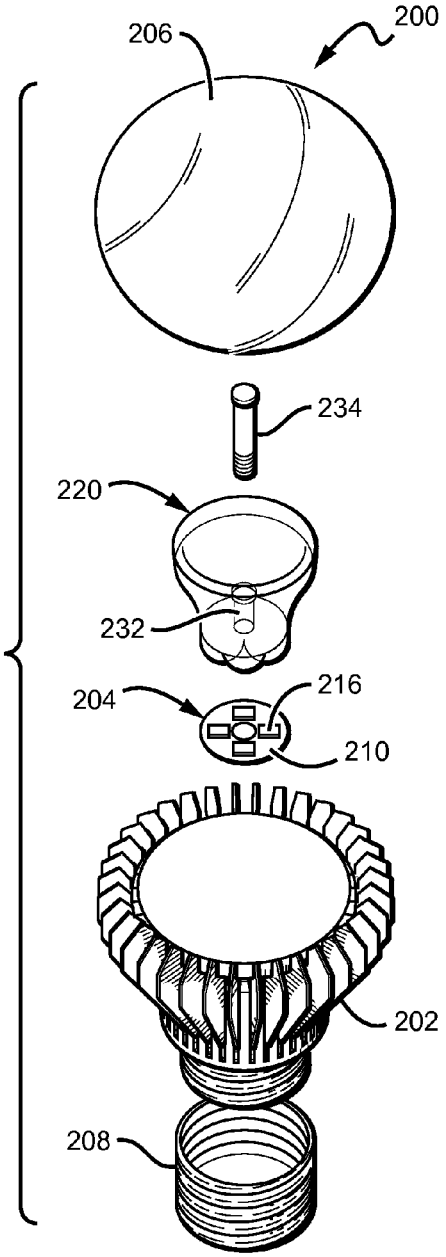
FIG. 17 is an exploded view of the lamp shown in FIG. 15.

FIGS. 15 through 17 show another embodiment of a lamp 200 according to the present invention having a heat sink structure 202, light source 204, phosphor carrier 206 and a screw-threaded portion 208, as described above. The phosphor carrier is three-dimensional and can include a thermally conductive transparent material and a layer of phosphor material as described above. It is also mounted to the heat sink structure 202, suitably with a thermal connection. The light source 204 comprises a one or a plurality of LED chips mounted on the top surface of the heat sink structure 202. It is understood that the lamps according to the present invention can also comprise other heat dissipation elements beyond a heat sink, such as heat pipes.

The lamp 200 also comprises a lateral spreading heat dissipation structure 210 below the LEDs to provide for improved thermal management of the heat generated by the LEDs. In conventional lamp arrangements the LEDs can be mounted on dielectric substrates (such as $Al_2O_3$), and heat from the LEDs can encounter the thermally resistant dielectric materials prior to having the opportunity to spread laterally. The different dissipation structures according to the present invention are arranged to laterally spread heat from the LEDs prior to the heat encountering the thermally resistant dielectric layer.

As mentioned above, the lamp 200 can also comprise remote phosphor carrier 206 that can have the feature and materials similar to those described above. In other embodiments, the lamp 200 can also comprise a diffuser, also as described above. By separating the phosphor material from the LEDs by arranging the phosphor in a remote phosphor carrier, improvements in light conversion efficiency and color uniformity can be obtained. For example, this arrangement allows for the use of a more disperse or dilute phosphor concentration, thereby reducing local heating of the phosphor particles, which reduces that impact that heat has on efficiency of the phosphor particles. The phosphor carrier 206 can comprise a thermally conductive material as described above to allow efficient flow of heat generated by the light conversion process from the phosphor material to the surrounding environment or to the heat sink 202.

By shaping the phosphor carrier 206 into a three-dimensional dome-shape, and illuminating the phosphor carrier with, for example, blue light from the LEDs 216 via the optical element, it is possible to ensure nearly identical path lengths through the phosphor carrier 206 for each light ray emitted from the LED. The probability of light conversion by the phosphor material in phosphor carrier 206 is generally proportional to the path length of light through the phosphor material (assuming substantially uniform phosphor concentrations), uniform color emission can be achieved with the mixture of direct and downconverted LED light, over a broad range of beam angles.

Another advantage of the lamp arrangements according to the present invention having an optical element 220 and remotely located phosphor carrier 206 (or scattering layer) is that the arrangement serves to reduce the amount of light absorbed in the during operation of the lamp 200, thereby increasing the over efficacy of the lamp 200. In a typical LED lamp that incorporates one or more phosphors in combination with an LED, the phosphor is located in close proximity to the LED chip. Thus, a significant portion of the light that is emitted by or scattered by the phosphor is directed back towards the LED chip and/or other absorbing surfaces surrounding the chip. This can lead to light absorption and light loss at these surfaces. The lamps embodiments described herein can reduce this light loss in that light emitted or scattered by the remote phosphor carrier 206 (or diffuser) has reduced chance of being directed into the LED chip surface or adjacent absorbing regions due to the optical design of the optical element. It some embodiments, a low-loss scattering or reflective material can be placed on the interior surfaces of the lamp 200 (such as the surface of the dielectric layer or heat sink) to further limit the absorption of light emitted or scattered by the remote phosphor carrier.

The lamp 200 shown in FIG. 15 through 18 comprises a simple and inexpensive arrangement for achieving physical and thermal contact between the heat spreading substrate 212 and the heat sink 202. The optical element 220 can comprise a central opening or hole 232 through which a fastener or clamping connector (such as a screw or clip) 234 can pass and be mounted to the heat sink 202. This connector 234 can serve to "clamp" or press the optical element 220, heat spreading substrate 212, dielectric layer 214, and heat sink 202 together. This serves to attach these portions of the lamp 200 together, as well as pressing the heat spreading substrate 212 to the heat sink 202 with a dielectric layer 214 between the two. This can eliminate the need for an adhesive or solder joint layer between these elements that can add expense, manufacturing complexity, and can inhibit heat flow between the LED chip 216 and the ambient.

Another advantage with this arrangement is that it allows for convenient "re-working" of the lamp during manufacturing by allowing for the easy removal of defective lamp components without the danger of damage to surrounding components. This feature can also provide for lifetime cost reduction in that failing components (such as the LED package assembly) could be removed and replaced without replacing the entire lamp assemble (heat sink, bulb enclosure, etc. which typically have very long lifetimes). Further, this component-based assembly could help reduce manufacturing costs since different color point lamps could be achieved simply by replacing the bulb enclosure/phosphor carrier, allowing for uniform manufacture of the remainder of the assembly across color points. As an added benefit, multiple bulb enclosures with different phosphor combinations could be provided to the customer to allow flexible in-service changing of the color/hue of the lamp by the customer.

Figure 18:
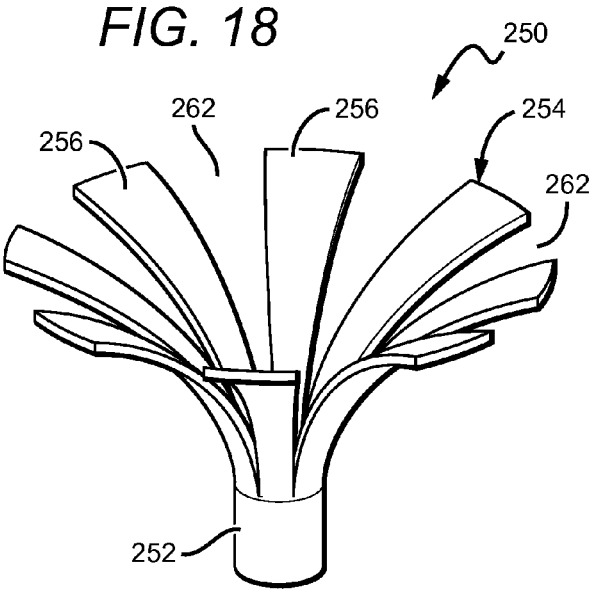
FIG. 18 is a perspective view of another embodiment of an optical element according to the present invention.
Figure 19:
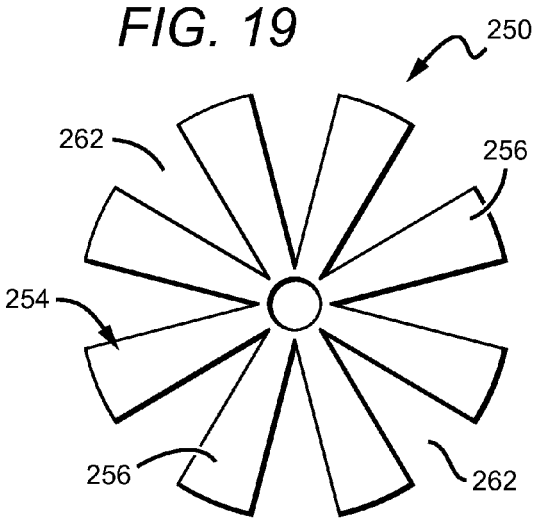
FIG. 19 is a top view of the optical element shown in FIG. 18.
Figure 20:
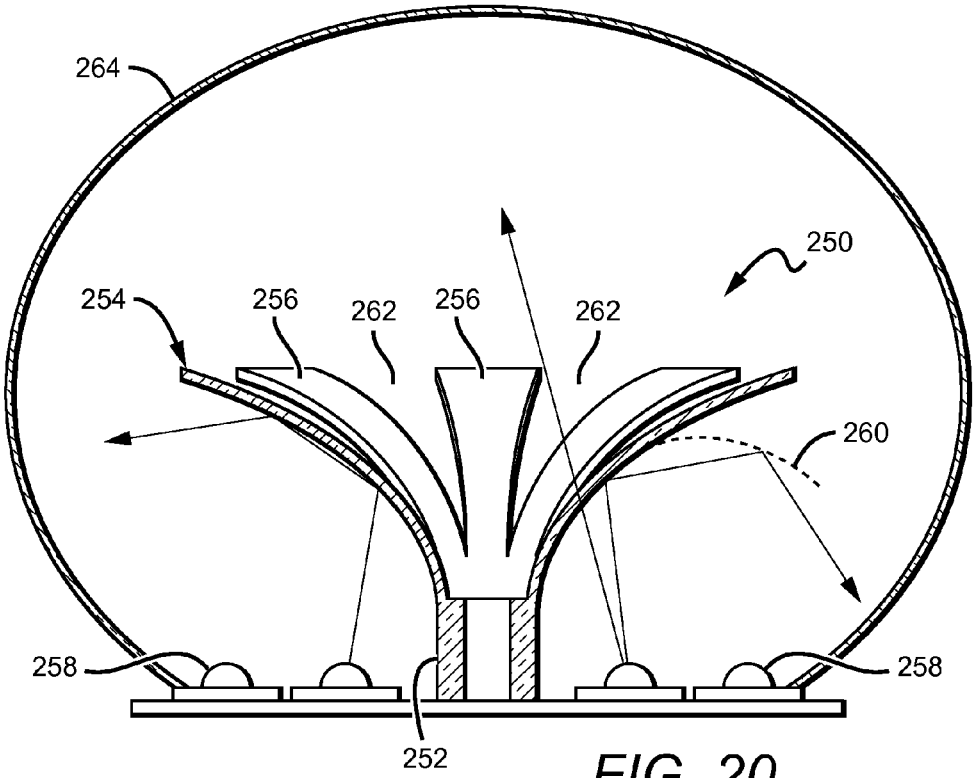
FIG. 20 is a side view of another embodiment of a lamp according to the present invention.

It is understood that many different optical elements can be arranged in many different ways according to the present invention. They can have many different shapes, made of many different materials, and can have many different properties. FIGS. 18 through 20 show an embodiment of an optical element 250 according to the present invention that can utilize specular and/or scattering reflections to redirect the light from the LED sources into larger beam angles or preferred directions. Optical element 250 is generally flower shaped and is particularly applicable to redirecting light from co-planar solid state light sources such as co-planar LEDs. The optical element comprises a narrow bottom or stem section 252 that can be mounted to the co-planar light source. In the embodiment shown, the bottom section comprises a hollow tube section, but it is understood that it can comprise many different shapes and may not be hollow.

The optical element also comprises an upper reflective section 254 that spreads from bottom section 252 moving up the optical element. The upper section 254 comprises a series of reflective blades or petals 256 that are over the LEDs 258 (best shown in FIG. 20) so that light from the LEDs 258 strikes the bottom surface of the blades 256 and is reflected. In the embodiment shown, the width of the blades 256 increase moving up the optical element 250 to reflect more LED light at the top, but it is understood that the in other embodiments the blades can have the same or decreasing width moving up the optical element. It is also understood that different ones of the blades can have different widths or can have widths increase or decrease in different ways moving up the optical element.

The reflection of LED light from the blades 256 helps disperse the light from the LEDs 258 to the desired emission pattern. The blades 256 can be angled or curved from the bottom section, and depending on the desired emission pattern, the blades can have different curves or angles. There can be different curves or angles in different portions of the blades 256 and different ones of the blades can have different angles and curves. Referring now to FIG. 20, a increased curvature blade 260 is shown, with the increased curvature causing reflection at higher beam angles. The light reflected from the high curvature blade 260 emits in more of a downward direction. This can result in an overall lamp emission with a portion of emission at higher beam angles that is particularly useful in embodiments where omni-directional emission is desired (e.g. Energy Star® emission).

There can also be a space 262 between the blades 256 that allows light from the LEDs 258 to pass. The light passing the blades 256 can provide forward emitting light from the LEDs, which can also be useful in embodiments where omni-directional emission is desired. Different embodiments can have different numbers and sizes of blades 256 and spaces 262 depending on the desired emission pattern. In some embodiments, the space 262 between the blades 256 can include a conversion or disperser material that can convert or disperse the LED light as it passes through the space.

Optical element 250 can provide certain advantages in that the dispersing element can be light-weight and fabricated inexpensively from tube or horn-shaped foils or reflective polymer elements. In other embodiments the optical element 250 can simply comprise reflective paper or plastic. Further, by relying on specular and/or scattering reflection, the size of the element may be reduced relative to elements utilizing TIR since TIR surfaces may only reflect the incident light up to a maximum angle determined primarily by the difference in index of refraction between the element and the surrounding ambient.

It is understood that the specular and/or scattering optical elements can have many different shapes and sizes and can be arranged in many different ways. In some embodiments, the spaces between the blades can comprise different shapes such as holes or slots, and the spaces can be in many different locations. It is also understood that the optical element can be mounted in lamps in many different ways beyond mounting to the light source. In some embodiments it can be mounted to a phosphor carrier or diffuser. Other optical element embodiments may include a combinations of TIR, specular reflection and scattering to achieve the desired beam dispersion.

The optical element 250 can be used in lamp also comprising a phosphor carrier 264 (best shown in FIG. 20). The phosphor carrier 264 can have the same features as those described above and can be made of the same materials. The phosphor carrier 264 can have a dome-shape over the optical element 250 and LEDs 258 and comprise a conversion material, such as a phosphor, that converts at least a portion of the LED light passing through it. The phosphor carrier 264 can also disperse the light thereby smoothing out emission intensity variations to the blocked or reflected light from the optical element 250. Other embodiments can also comprise a diffuser (not shown) over the phosphor carrier to further disperse the light into a desired emission pattern. The diffuser can have the same features and can be made of the same materials as the diffusers described above.

The LED arrays according to the present invention can be coupled together in many different serial and parallel combinations. In one embodiment, the red and blue LEDs can be interconnected in different groups that can comprise their own various series and parallel combinations. By having separate strings, the current applied to each can be controlled to produce the desired lamp color temperature, such as 3000K.

Some LED lamps according to the present invention can have a correlated color temperature (CCT) from about 1200K to 3500K, with a color rendering index of 80 or more. Other lamp embodiments can emit light with a luminous intensity distribution that varies by not more than 10% from 0 to 150 degrees from the top of the lamp. In other embodiments, lamps can emit light with a luminous intensity distribution that varies by not more than 20% from 0 to 135 degrees. In some embodiments, at least 5% of the total flux from the lamps is in the 135-180 degree zone. Other embodiments can emit light having a luminous intensity distribution that varies by not more than 30% from 0 to 120 degrees. In some embodiments, the LED lamp has a color spatial uniformity of such that chromaticity with change in viewing angle varies by no more than 0.004 from a weighted average point. Other lamps can conform to the operational requirements for luminous efficacy, color spatial uniformity, light distribution, color rendering index, dimensions and base type for a 60-watt incandescent replacement bulb.

The lamps according to the present invention can emit light with a high color rendering index (CRI), such as 80 or higher in some embodiments. In some other embodiments, the lamps can emit light with CRI of 90 or higher. The lamps can also produce light having a correlated color temperature (CCT) from 2500K to 3500K. In other embodiments, the light can have a CCT from 2700K to 3300K. In still other embodiments, the light can have a COT from about 2725K to about 3045K. In some embodiments, the light can have a CCT of about 2700K or about 3000K. In still other embodiments, where the light is dimmable, the CCT may be reduced with dimming. In such a case, the CCT may be reduced to as low as 1500K or even 1200K. In some embodiments, the CCT can be increased with dimming. Depending on the embodiment, other output spectral characteristics can be changed based on dimming.

Figure 21A:
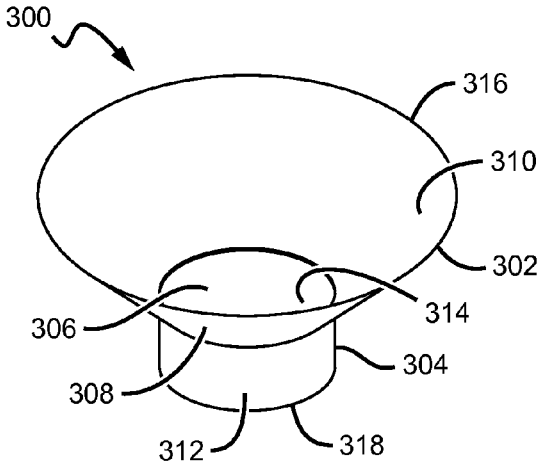
FIG. 21A is a perspective view of another embodiment of an optical element.
Figure 21B:
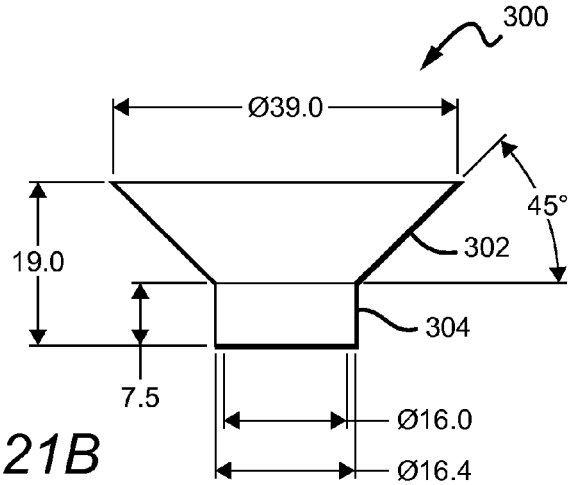
FIG. 21B is a side view of the embodiment of FIG. 21A with exemplary dimensions.

Embodiments of the present invention can comprise many different shapes and sizes of optical elements that are arranged in many different ways. FIGS. 21A and 21B show another embodiment of an optical element 300 according to the present invention that can utilize specular and/or scattering reflections to redirect the light from the LED sources into larger beam angles or preferred directions using one or more surfaces. The optical element 300 is generally funnel shaped and has a frustoconical top portion 302 and a cylindrical bottom portion 304. The top portion has a top outer surface 308 and a top inner surface 310, while the bottom portion has a bottom outer surface 312 and a bottom inner surface 314. In the embodiment shown, these surfaces are all solid. The optical element 300 can be used to redirect light from solid state light sources such as co-planar LEDs, or in some embodiments LEDs that are not co-planar. In preferred embodiments the optical element 300 has a cavity 306. In the embodiment shown, the optical element 300 is completely hollow.

FIG. 21B shows the dimensions of one embodiment of an optical element 300 that can be used in a solid state lamp and, in some embodiments, aid in making the lamp emission more omnidirectional, although many other shapes and sizes are possible. The frustoconical top portion 302 has an outer diameter of 39 mm and an inner diameter of 16 mm, and rises at an angle of 45° from vertical. The top portion 302 has a height of 11.5 mm, while the cylindrical bottom portion 304 has a height of 7.5 mm, for a total optical element 300 height of 19 mm. The wall thickness of the optical element 300 is 0.2 mm. While the optical element 300 has these dimensions, many other embodiments of optical elements have different dimensions, and the dimensions of the optical element 300 are only exemplary and are in no way meant to be limiting. For example, the angle of the frustoconical top portion 302 can be less than or greater than 45° from vertical; further, an optical element can have an angled portion that is 90° from vertical such that it is flat, or can have no angled portion at all so that the optical element is simply cylindrical. The measurements of the optical element 300 are limited only by the bulb in which it is placed; for instance, an optical element can be as tall as a bulb, and even connect to the top of a bulb, and could also be as wide as the bulb.

The size and shape of the optical element 300 can vary based on many different factors. One factor is the desired lamp emission profile. For example, if broader emission is desired, then the optical element can have an angled portion that is flatter, such as 60° from vertical. Another such factor is the type of solid state emitter used in a lamp comprising the optical element 300. For example, if an emitter has a Lambertian emission pattern, then the optical element 300 can have a portion that is flatter and/or curves outward so as to reflect more light to higher angles. If an emitter already emits a broad emission pattern broader than a Lambertian pattern, then the optical element 300 might sometimes not need such a flat angled surface since it does not need to redirect light as much. Another factor that can be considered when designing the optical element 300 is the placement of the solid state emitters in relation to the optical element and the rest of the lamp. For example, if the emitters are placed close to the optical element, the optical element can have an angled portion that begins below a height of 7.5 mm so that more light emitted from a closer emitter encounters the angled surface; in some instances the optical element could only consist of a frustoconical portion without a bottom portion. The dimensions of the optical element can also depend on, for example, the type of diffuser used. For example, if a lamp comprises a diffuser with a high concentration of diffusing/scattering particles, then the optical element will not need to redirect as much light as when a diffuser with a low concentration of diffusing/scattering particles is used, and the optical element's design will therefore change accordingly. Many different factors such as desired lamp emission profile, chip or package type, chip or package placement, diffuser type, and remote phosphor type (if present), among others, should be considered in the design of the optical element 300.

Similar to the optical element 220 in FIG. 15 and the optical element 250 in FIG. 18, the optical element 300 can be made of material and can have a shape that allows for efficient alteration of the emission profile with minimal light loss. In a preferred embodiment, the optical element 300 can comprise a reflective material such that one or more of the surfaces 308, 310, 312, and 314 are reflective, although in some embodiments the optical element can be either fully or translucent partially transmissive or transparent. In some embodiments these surfaces can be white. In some embodiments the optical element 300 comprises a white plastic, such as white plastic sheet(s) or one or more layers of microcellular polyethylene terephthalate ("MCPET"), and in some embodiments the optical element 300 comprises white paper. The surfaces can be Lambertian or diffuse reflectors. Embodiments with diffuse reflector surfaces can have a broader lamp emission profile. In some embodiments the optical element 300 and/or the surfaces 308, 310, 312, and 314 can have a white film, such as White97™ Film available from WhiteOptics, LLC, of New Castle, Del. In other embodiments they can comprise metal, including but not limited to WhiteOptics™ Metal, available from WhiteOptics, LLC, or similar. In some embodiments, the optical element 300 can be a plastic or metal device that is coated with a reflective material. Materials can also include specular reflectors which can help directly control the angle of redirected light rays, Lambertian reflectors, combination specular/Lambertian reflectors, and even partially translucent reflectors.

In one embodiment the surfaces 308, 310, 312, and 314 are of equal reflectivity. However in other embodiments, one or more surfaces can have a higher reflectivity than one or more of the other surfaces. For example, in one embodiment the top outer surface 308 is more reflective than the top inner surface 310. In another embodiment the top outer surface 308 is more reflective than the bottom outer surface 312. In yet another embodiment, the bottom outer surface 312 is more reflective than the bottom inner surface 314. Many different combinations of surface reflectivity are possible. Further, the surfaces 308, 310, 312, and 314 can themselves each have different sections of reflectivity, including but not limited to a top portion having more reflectivity than a bottom portion, a bottom portion having more reflectivity than a top portion, or a gradient of reflectivity from top to bottom or bottom to top.

The surfaces 308, 310, 312, and 314 can also exhibit different kinds of reflectivity. For example, in one embodiment the outer surfaces 308 and 312 are diffuse reflectors, while the inner surfaces 310 and 314 are specular reflectors, and vice versa. Further, in some embodiments the top surfaces 308 and 310 are a first type of reflector, while the bottom surfaces 312 and 314 are another type of reflector. These embodiments are only exemplary, as many different combinations of surface reflector types are possible.

FIG. 22 is a cross sectional view of one embodiment of a diffuser 350 according to the present invention. In the FIG. 22 embodiment the diffuser has an oblong frustospherical shape; that is to say, the horizontal diameter is larger than the vertical diameter. Many other diffuser shapes, such as frustospherical, hemispherical, or a shape similar to that of the diffuser dome 110 of FIG. 4, among others, are possible. In the embodiment shown, the diffuser 350 is a single continuous piece, although in other embodiments it can comprise two or more pieces which can be bonded together. The diffuser 350 can have a bottom opening 352. The inner or outer surfaces of the diffuser can be roughened in order to increase light extraction and/or increase scattering.

The diffuser 350 can include diffusing or scattering particles (used interchangeably herein) comprising many different materials such as:

silica gel;
zinc oxide (ZnO);
yttrium oxide ($Y_2O_3$);
titanium dioxide ($TiO_2$);
barium sulfate ($BaSO_4$);
alumina ($Al_2O_3$);
fused silica ($SiO_2$);
fumed silica ($SiO_2$);
aluminum nitride;
glass beads;
zirconium dioxide ($ZrO_2$);
silicon carbide (SiC);
tantalum oxide ($TaO_5$);
silicon nitride ($Si_3N_4$);
niobium oxide ($Nb_2O_5$);
boron nitride (BN); or
phosphor particles (e.g., YAG:Ce, BOSE)

Other materials not listed can also be used. Various combinations of materials or combinations of different forms of the same material can be used to achieve a particular scattering effect. For example, in one embodiment some scattering particles can comprise alumina and other scattering particles can comprise titanium dioxide. It is understood that the diffuser 350 can also comprise mixtures of scattering particles made of different materials. Scattering particles can be uniformly or non-uniformly distributed on one or more surfaces of the diffuser 478. Further, different regions of the diffuser 478 can include different types and/or concentrations of scattering particles; some regions can contain no scattering particles. In one embodiment, the lower half of the diffuser 478 has a higher concentration of scattering or diffusing particles than the upper half. Scattering particles can be on the inside of the diffuser, the outside of the diffuser, within the diffuser material, or combinations thereof. Many different types of diffusers and/or scattering particles that can be included in a device according to the present application are described in U.S. patent application Ser. No. 12/901,405 to Tong et al. entitled "Non-Uniform Diffuser to Scatter Light into Uniform Emission Pattern," including but not limited to a generally asymmetric "squat" shape, and U.S. patent application Ser. No. 12/498,253 to Le Toquin entitled "LED Packages with Scattering Particle Regions," the figures and descriptions of both of which are hereby fully incorporated by reference herein.

One method of coating the inside surface of a diffuser is the fill-and-dump method. In the fill and dump method, the diffuser is turned upside down and filled with a liquid containing scattering or diffusing particles. The liquid is allowed to remain for a certain period of time. Then the diffuser is turned right-side-up and the liquid is removed from the inside of the diffuser. This method of coating can result in a substantially uniform coating of scattering or diffusing particles.

Figure 25:
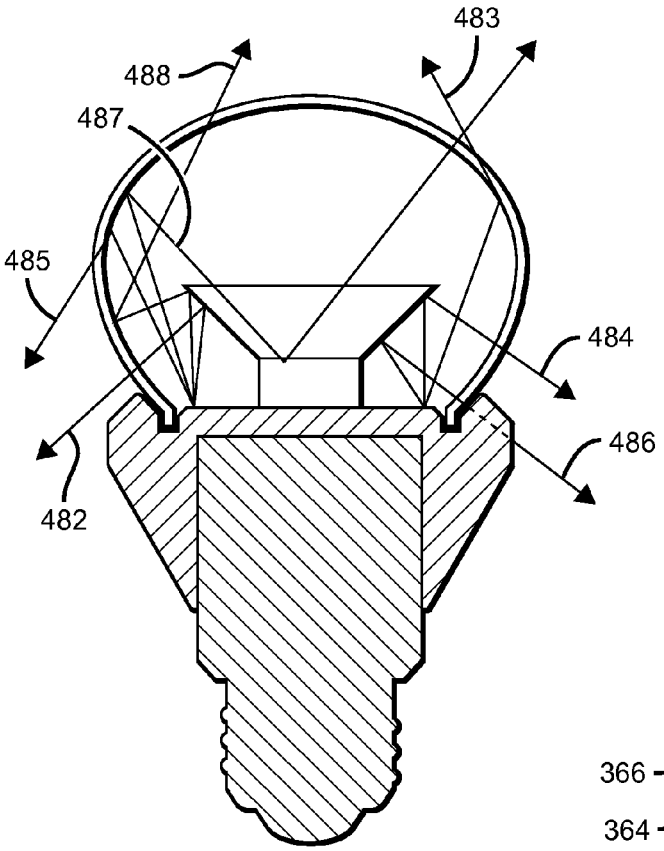
FIG. 25 is a cross sectional view of the lamp shown in FIG. 23.

FIGS. 23-25 show perspective, side, and cross sectional views of an embodiment of a lamp 400 according to the present invention. The lamp comprises the optical element 300, an array of solid state emitters 402 and 404, a carrier 406, a heat sink structure 472 comprising vertical fins 474, and a diffuser 478 around the optical element 300. In the FIGS. 23-25 embodiment, the optical element 300 is below the equator 490 of the frustospherical diffuser 478. In another embodiment an optical element is in the lower half of a diffuser. In yet another embodiment the optical element is in the lower and upper halves of the diffuser 478. In yet another embodiment, the top surface of an optical element is at or below the equator 490 of the diffuser 478.

Figure 26:
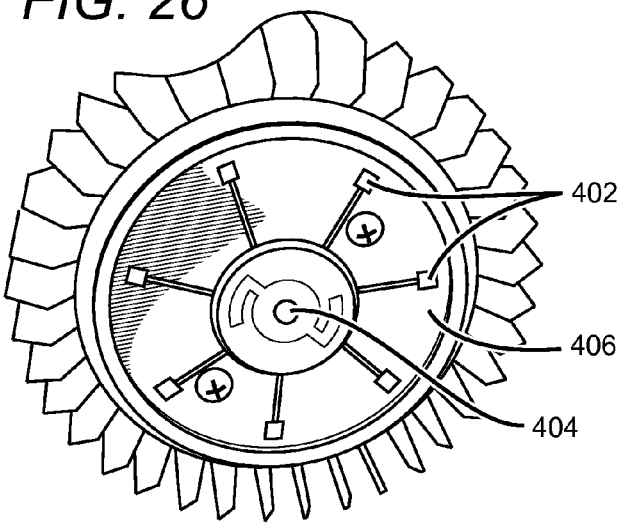
FIG. 26 is a top view of an LED array according to the present invention.

In the embodiment shown, the lamp 400 comprises 7 outer solid state emitters 402 and one inner solid state emitter 404, which can be a central solid state emitter, for a total of eight solid state emitters. This layout is best seen in FIG. 26. This is but one embodiment of a chip layout according to the present invention, as many other chip layouts are possible. Other embodiments can have more or less outer solid state emitters 402 and/or more than one inner solid state emitter 404; one embodiment comprises nine outer solid state emitters 402 and one inner solid state emitter 404 for a total of ten solid state emitters. In the embodiment shown, the solid state emitters 402 and 404 and the optical element 300 are mounted on the carrier 406. Examples of carriers can include, but are not limited to, a printed circuit board (PCB) carrier, substrate or submount. The carrier can be reflective to increase the overall output of the lamp. The carrier 406 and the diffuser 478 are mounted on the heat sink 472, as shown in FIGS. 23-25. In other embodiments the diffuser 478 can be mounted on the carrier 406. In a preferred embodiment the diffuser 478 is similar to or the same as the diffuser 350.

The lamp 400 comprises an inner solid state emitter 404 in the cavity 306. Because the optical element 300 is completely hollow (i.e., the cavity extends through the entire optical element and extends to the outer walls of the optical element 300), the inner solid state emitter 404 is mounted on the carrier 406. In this embodiment the inner solid state emitter 404 is mounted in the center of the carrier 406, although other embodiments are possible. In other embodiments the cavity 306 may not extend all the way through the optical element 300, and can only extend through either part of the top portion 302 or through the top portion 302 and part of the bottom portion 304, thus forming a bottom floor of the cavity 306. In such a case, the inner solid state emitter 404 can be mounted on the optical element 300 inside the cavity 306. The optical element 300 can be thermally conductive in order to transfer heat away from the inner solid state emitter 404.

The array of solid state emitters 402 and 404 can be arranged in many ways. In the embodiment of FIGS. 23-25, all of the solid state emitters 402 and 404 are mounted on the carrier, and all of the solid state emitters 402 and 404 are coplanar and form a planar array, as shown in FIG. 26. The outer solid state emitters 402 are arranged in a ring around the base 318 of the optical element 300. The optical element 300 is over the solid state emitters 402 and 404; in some embodiments, the top section 302 can be over one or more of the outer solid state emitters 402. In one such embodiment, the top edge 316 of the optical element 300 is over one or more of the outer solid state emitters 402. The outer solid state emitters 402 are equidistant from the base 318 and equidistant from one another. In the embodiment shown, the emitters 402 are near the perimeter of the carrier 406; in other embodiments, the emitters 402 can actually be on the perimeter of the carrier 406, or can be closer to the base 318. Placing the outer solid state emitters 402 on or near the perimeter of the carrier 406 can result in a more omnidirectional lamp emission due to the angles at which the light emitted from the emitters can reflect off of the optical element 300.

Many different types of solid state emitters 402 and 404 can be used in the lamp 400. In some embodiments the solid state emitters are LEDs. Many different LEDs can be used such as those commercially available from Cree Inc., under its DA, EZ, GaN, MB, RT, TR, UT and XT families of LED chips. Further, many different types of LED packages can be used in embodiments of the present invention. Some types of chips and packages are generally described in U.S. patent application Ser. No. 12/463,709 to Donofrio et al., entitled "Semiconductor Light Emitting Diodes Having Reflective Structures and Methods of Fabricating Same," U.S. patent application Ser. No. 13/649,052 to Lowes et al., entitled "LED Package with Encapsulant Having Planar Surfaces," and U.S. patent application Ser. No. 13/649,067 to Lowes et al., entitled "LED Package with Multiple Element Light Source and Encapsulant Having Planar Surfaces," the descriptions and figures of all three of which are hereby fully incorporated by reference herein. The solid state emitters 402 and 404 can emit many different colors of light, with preferred emitters emitting white light (or chips emitting blue light, part of which is converted to yellow light to form a white light combination). One preferred embodiment of a package that can be used in a lamp according to the present invention comprises a substantially box shaped encapsulant, which results in a package emission that is broader than Lambertian; many of these packages are shown and described in U.S. patent application Ser. No. 13/649,067 to Lowes et al. It is understood that in some embodiments the LED can be provided following removal of its growth substrate. In other embodiment, the LED's growth substrate can remain on the LED, with some of these embodiments having a shaped or textured growth substrate. In some embodiments when the LED's growth substrate remains on the LED, the LED is flip-chip mounted onto the carrier 406.

In other embodiments solid state lasers can used either alone or in combination with one or more LEDs. In some embodiments, the LEDs can comprise a transparent growth substrate such as silicon carbide, sapphire, GaN, GaP, etc. The LED chips can also comprise a three dimensional structure and in some embodiments, the LEDs can have structure comprising entirely or partially oblique facets on one or more surfaces of the chip.

In a preferred embodiment, the emitters 402 and 404 are LED chips and/or packages which can, in some embodiments, have an emission pattern that is broader than Lambertian, such as, for example, those described in U.S. patent application Ser. Nos. 13/649,052 and 13/649,067. In another embodiment, the emitters 402 and 404 are phosphor-coated LEDs such as, for example, those described in U.S. patent application Ser. Nos. 11/656,759 and 11/899,790. In one embodiment the emitters these aspects and are phosphor-coated LED chips and/or packages with emission patterns that are broader than Lambertian. In another preferred embodiment, these LEDs emit in the blue spectrum and are covered in a yellow phosphor, resulting in a white emission. In another embodiment the emitters 402 and 404 have a Lambertian emission profile.

In one embodiment all of the emitters 402 and 404 are the same type of solid state emitter, for example, LED packages emitting white light or phosphor coated LEDs that emit a blue/yellow combination of white light. In another embodiment, the inner solid state emitter 404 is different than the outer solid state emitters 402, and the inner solid state emitter 404 can emit more or less light and/or emit a different type of light. In another embodiment, the emitters 402 emit different types of light; in one embodiment, some of the emitters 402 are BSY (blue shifted yellow) LEDs while the rest are red LEDs, resulting in a white lamp emission.

The lamp 400 can also comprise a heat sink element 472 to aid in thermal dissipation, as shown in FIGS. 23-25. Different heat dissipation arrangements and structures are described in U.S. Provisional Patent Application Ser. No. 61/339,516, to Tong et al., entitled "LED Lamp Incorporating Remote Phosphor With Heat Dissipation Feature," also assigned to Cree, Inc. the descriptions and figures of which are fully incorporated herein by reference. The heat sink 472 can comprise a plurality of fins 474, preferably vertical. Each fin 474 can comprise an angled upper portion 476. In a preferred embodiment, the upper portion 476 is angled such that some light reflected by the optical element 300 is emitted from the lamp 400 at an angle substantially parallel to the angled upper portion 476 as shown by the ray trace 482 in FIG. 25. In another embodiment, the upper portion 476 is angled such that some light reflected by the optical element 300 is emitted from the lamp 400 at an angle slightly above the upper portion 476 such that the light does not encounter the heat sink, as shown by a ray trace 484. The angle of the upper portion 476 can be approximately 135° from vertical, although other angles are possible. The angled upper portion 476 can also be angled such that it is steeper than the perpendicular of an angled optical element surface, or such that the perpendicular of an optical element surface is flatter than the angled upper portion 476. In another embodiment, the heat sink fins 474 are reflective such that light can be reflected off of the heat sink and contribute to the omnidirectional emission pattern of the lamp 400. Further, in a preferred embodiment there are spaces in between the heat sink fins such that light emitted at an angle such that it would intersect a fin can instead pass through the space to emit at large angle, as is shown by the ray trace 486.

The lamp 400 can be designed to have a more omnidirectional emission pattern than a Lambertian pattern. In order to achieve such an emission pattern the lamp can emit more light at higher angles, as shown by the ray traces 482, 484, 485, and 486 in FIG. 25. In the FIGS. 23-25 embodiment, however, the optical element 300 can be over the emitters 402, meaning that the contribution of the emitters 402 to forward emission of the lamp 400 can be limited. In this embodiment, some of the light emitted by the outer solid state emitters 402 can reflect off of the optical element 300 before encountering the diffuser 478. While some of the light will pass through the diffuser 478 as shown by ray traces 482 and 484, some light will actually reflect off the diffuser 478 and remain in the lamp 400 before passing out the top surface of the diffuser 478, as shown by a ray trace 488. Light that passes by the optical element 300 will encounter the diffuser 478. Some light that encounters the diffuser 478 might scatter or diffuse, as shown by the ray traces 483 and 485, or might pass straight through the diffuser 478. Light with a path that is altered by the diffuser 478 can contribute to the high angle emission of the lamp 400 as shown by the ray trace 485, and thus aid the lamp 400 in having a more omnidirectional emission pattern. Light with a path that is altered by the diffuser 478 can also emit to the forward emission of the lamp 400. For example, the inner surface of the top portion 302, shown in FIG. 32, can be reflective, such that both the upper and lower surfaces of the optical element 300 are reflective. As shown by the ray trace 487, light can sometimes reflect off of the diffuser 478 back into the bulb, and then reflect off of the top surface of the optical element 300 and contribute to the forward emission of the lamp 400. In other embodiments the optical element 300 is not directly over the emitters 402 such that the emitters contribute directly to the forward emission of the lamp 400.

The combination of the optical element 300 and the diffuser 478 can provide the added advantage of distributing the light emitting from the optical cavity in a more uniform pattern. As discussed above, light from the light source can be emitted in a pattern generally broader than a Lambertian pattern and the shape of the dome 478 along with the scattering properties of the scattering particles can cause light to emit from the dome in a more omnidirectional emission pattern. An engineered diffuser can have scattering particles in different concentrations in different regions or can be shaped to a specific emission pattern. For example, if an emission pattern with more forward emission was desired, the diffuser could have a higher concentration of scatting particles in its lower portion such that more light passing through the lower portion of the diffuser (and thus probably not contributing to forward emission) could be scattered and/or redirected. In some embodiments, including those described herein, the lamp can be engineered so that the emission pattern from the lamp complies with the Department of Energy (DOE) Energy Star® defined omnidirectional distribution criteria. One requirement of this standard met by the lamps herein is that the emission uniformity must be within 20% of mean value from 0 to 135° viewing and >5% of total flux from the lamp must be emitted in the 135-180° emission zone, with the measurements taken at 0, 45, 90° azimuthal angles. As mentioned above, the different lamp embodiments described herein can also comprise A-type retrofit LED bulbs, such as an A19 bulb, that meet the DOE Energy Star® standards. The present invention provides lamps that are efficient, reliable and cost effective. In some embodiments, the entire lamp can comprise five components that can be quickly and easily assembled.

A lamp such as lamp 400 from FIGS. 23-25 can be assembled in a number of different ways. In one preferred embodiment, a lamp can comprise the diffuser 350, as shown in FIG. 22. The bottom opening 352 can be approximately the same diameter as, or a slightly larger diameter than, the largest diameter of an optical element, such as the top edge 316 of the optical element 300 in FIG. 21. That is to say that the largest diameter of an optical element can be equal to or smaller than the diameter of a bottom opening of a diffuser. The diffuser 350 can therefore be lowered onto carrier and/or heat sink with an optical element passing through the bottom opening 352; the diffuser 350 can then be bonded to the rest of the lamp.

Figure 27:
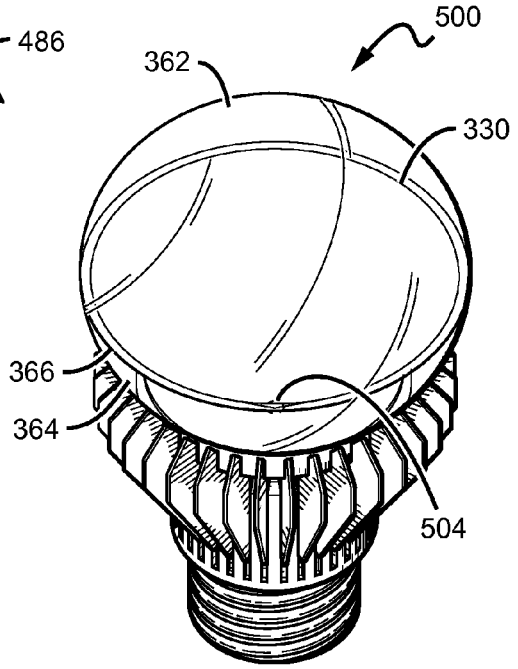
FIG. 27 is a perspective view of another embodiment of a lamp according to the present invention.
Figure 28:
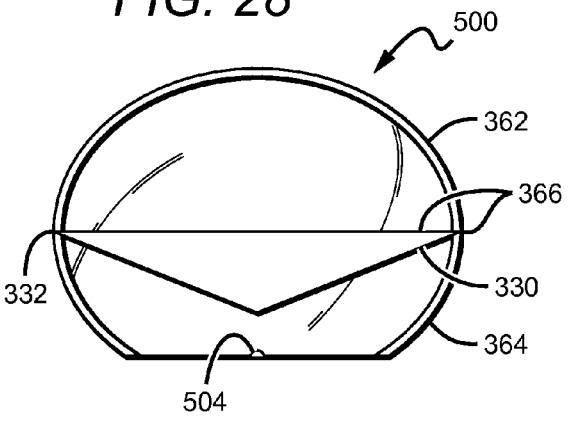
FIG. 28 is a cross sectional view of a section of the lamp shown in FIG. 27.

Other methods of assembly are possible. For example, FIG. 27 shows a lamp 500 with a diffuser 360 that comprises at least two parts: an upper portion 362 and a lower portion 364. A cross sectional view of the diffuser 360 and an optical element 330 is shown in FIG. 28. In the FIGS. 27 and 28 embodiment the upper and lower portions are divided at a bond line 366, in this case the equator of the diffuser 360, although in other embodiments the division can be elsewhere depending upon the desired emission profile. In the FIGS. 27 and 28 embodiment, the widest diameter 332 of the optical element 330 is approximately the same diameter and/or cross-section as the bond line 366. During the assembly of the lamp 500, the lower portion 364 is bonded to the lamp 500. The widest diameter 332 of the optical element 330 and the upper portion 362 of the diffuser can then be bonded onto the lower portion 364 such that the widest diameter 332 of the optical element 330 is sandwiched between the upper portion 362 and lower portion 364 at the bond line 366.

The assembly method described above allows for many different variations of the lamp 500. For example, the lamp can comprise a suspended optical element such as optical element 330 as seen in FIGS. 27 and 28. In a preferred embodiment, a suspended optical element is conical, although many other shapes are possible as described below. The lamp 500 can include a solid state emitter 504 bonded to the center of a carrier 508. In such an embodiment the optical element 330 can be partially translucent such that some light from the solid state emitters, including the solid state emitter 504, emits through the optical element 330. In another embodiment, the suspended optical element can comprise a cavity holding a solid state emitter. In yet another embodiment, one solid state emitter is in the center of a carrier while another solid state emitter is in a cavity of a suspended optical element.

Figure 29:
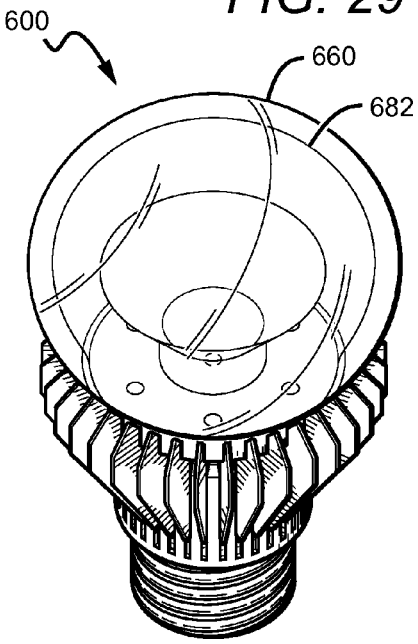
FIG. 29 is a perspective view of another embodiment of a lamp according to the present invention.
Figure 30:
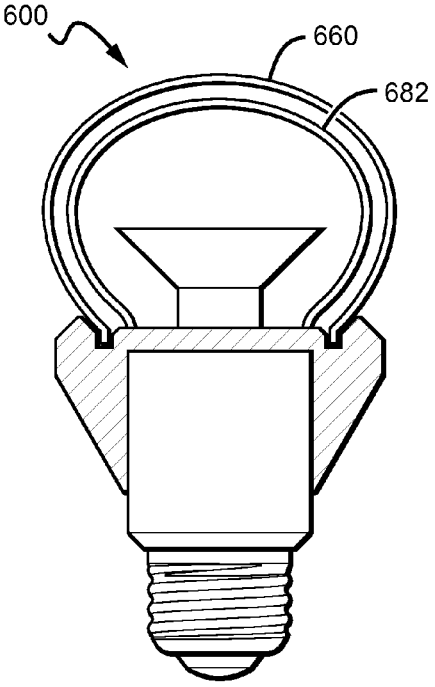
FIG. 30 is a cross sectional view of the lamp shown in FIG. 29.
Figure 31:
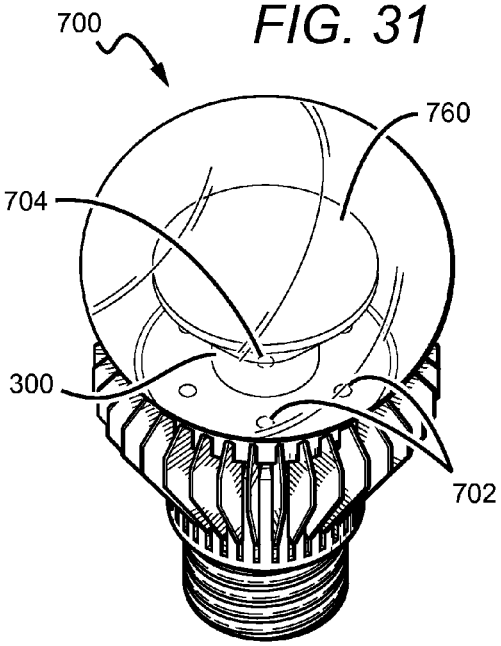
FIG. 31 is a perspective view of another embodiment of a lamp according to the present invention.

Lamps according to the present invention can also comprise various additional elements. For example, FIGS. 29 and 30 show a perspective view and a cut-away view of a lamp 600 comprising a phosphor carrier. Phosphor carriers are discussed in detail in U.S. patent application Ser. No. 13/029,068, filed on Feb. 16, 2011, the descriptions of which are fully incorporated herein by reference. In the embodiment shown the phosphor carrier 682 is a generally frusto-spherical element and matches the shape of the diffuser dome 660. Many other embodiments of phosphor carriers can be used in the lamp 600, including but not limited to the embodiments shown in FIGS. 6-9. Other phosphor carriers are also possible. For example, FIGS. 31 and 32 show a lamp 700 comprising a phosphor carrier 760. The phosphor carrier 760 is placed on top of the optical element 300, which can be thermally conductive to aid in dissipating heat from the phosphor carrier 760. In one embodiment, the phosphor carrier 760 only converts light emitted from the central solid state emitter 704, while light emitted from the solid state emitters 702 remains unconverted. In one such embodiment the central solid state emitter 704 emits blue light, some of which is converted to yellow light by the phosphor carrier 760 for a white light combination, and the solid state emitters 702 emit white light, either individually or in combination. In some embodiments, the diffuser can include phosphor particles, either as a coating on the inside or outside surface of the diffuser or distributed within the diffuser material itself. In some embodiments the phosphor particles also aid in mixing and/or diffusing light.

While the optical element 300 of FIG. 21A has a cylindrical bottom portion and a frustoconical top portion and the optical element 330 shown in FIGS. 27 and 28 is generally conical, many other shapes and designs of the optical element 300 are possible depending upon the desired emission pattern. For example, the optical element 250 of FIG. 18 can be used with an inner solid state emitter 404 if more forward emission is required, since light from the emitters 402 can pass through the openings 262. An optical element 800 shown in FIG. 33 is similar to the optical element 250 with side walls that curve outward, but does not comprise openings such that more light is reflected and emitted at high angles. The optical element 800 also has a flat top and does not comprise a cavity. This can help decrease the insertion loss of the lamp.

Figure 37:
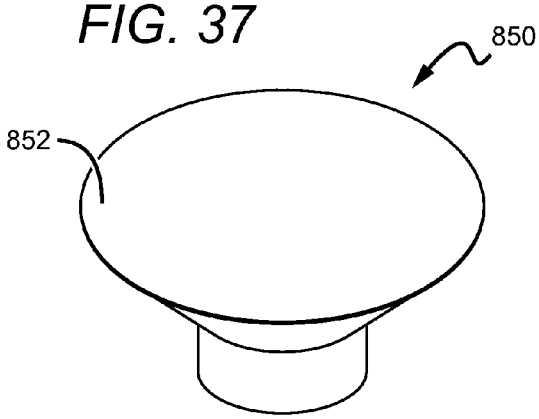
FIG. 37 is a perspective view of another embodiment of an optical element according to the present invention.

An optical element 810 shown in FIG. 34 does not comprise a bottom portion, but is simply frustoconical. An optical element 820 shown in FIG. 35 comprises slits 822 in its outer portion, which could allow more light to pass through the optical element 830 and emit at intermediate angles; although four slits are shown, more or less are possible. Further, horizontal slights are also possible. Some embodiments of an optical element are not hollow like the optical element 300 of FIG. 21. An optical element 840 shown in FIG. 36 has a cylindrical cavity 842 wherein a solid state emitter can be placed. The cavity 842 can extend all the way through the optical element 840, or can only extend through part of the optical element 840 such as to form a cavity floor; in one embodiment, the cavity floor is at the intersection between the upper portion 844 and the bottom portion 846 of the optical element 840. An optical element 850 shown in FIG. 37 does not have a cavity at all; instead, a solid state emitter can be placed on the top surface 852, or can be placed on a platform which is on the top surface 852.

Figure 38:
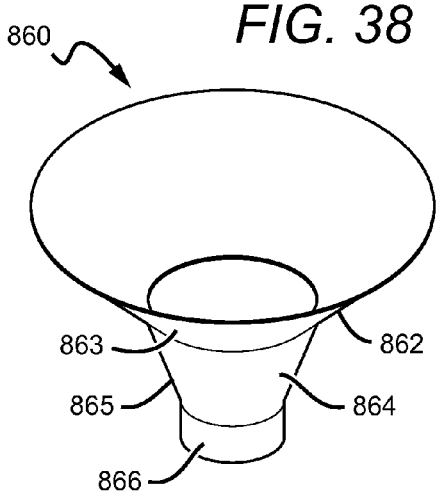
FIG. 38 is a perspective view of another embodiment of an optical element according to the present invention.

In the FIG. 38 embodiment, the side walls can change angle at distinct points rather than being curved such that the optical element comprises more than two portions. In the FIG. 38 embodiment the optical element 860 comprises a cylindrical bottom portion 866, a frustoconical middle portion 864 with side walls 865, and a top portion 862 with side walls 863 that are flatter than the middle portion side walls. In other embodiments the middle portion's side walls may be flatter than the top portion's side walls. Embodiments with more than three portions are also possible.

Figure 39:
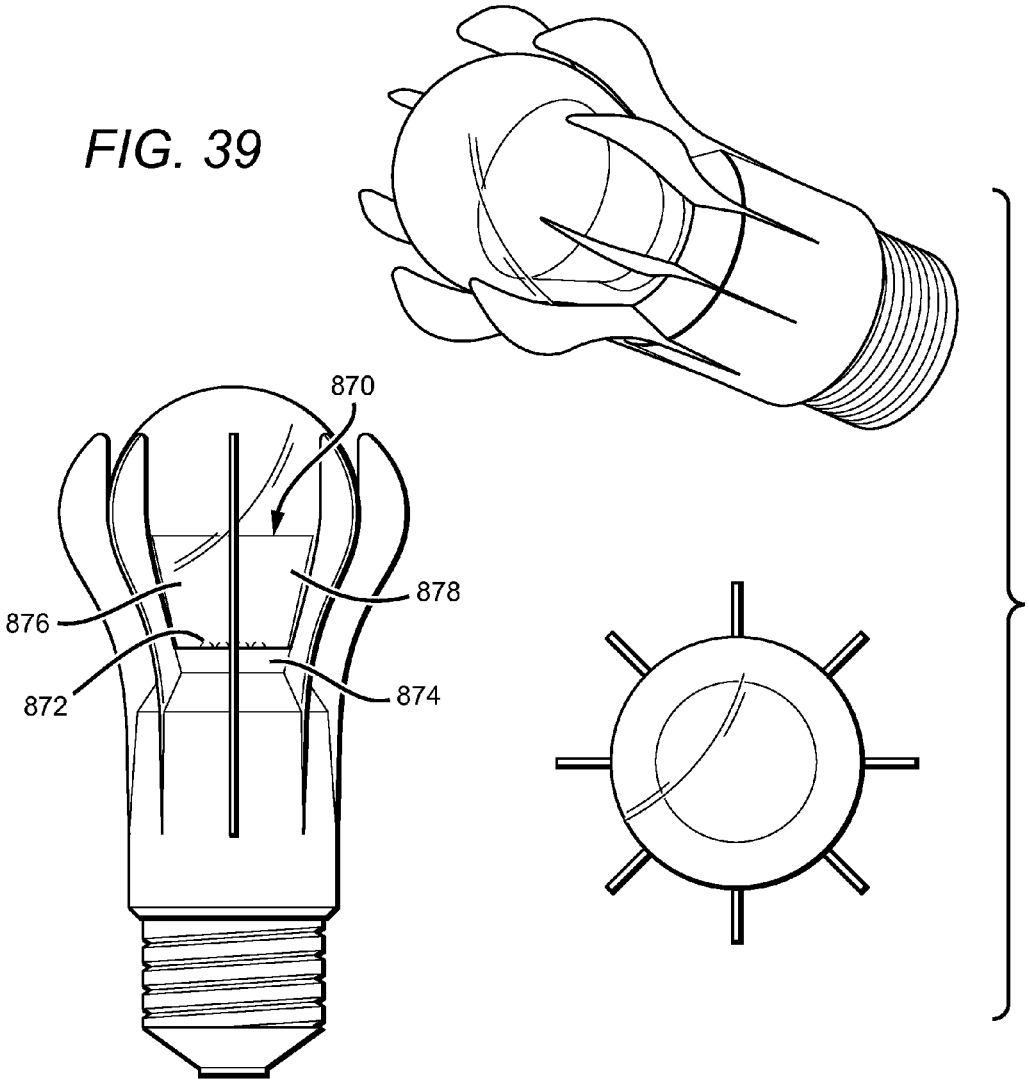
FIG. 39 is a perspective view of another embodiment of an optical element according to the present invention.

FIG. 39 shows an embodiment of an optical element 870. The optical element 870 is frustoconical, but has a very steep outer surface 876. In other embodiments the outer surface can curve outwards so as to form a horn shape. A solid state emitter array 872 is within the interior of the optical element 870. The emitter array 872 is on element 874. Element 874 can be a separate carrier as previously described, or can be integral to the optical element 870 such that the top of element 874 forms the bottom of a cavity 878.

Figure 40:
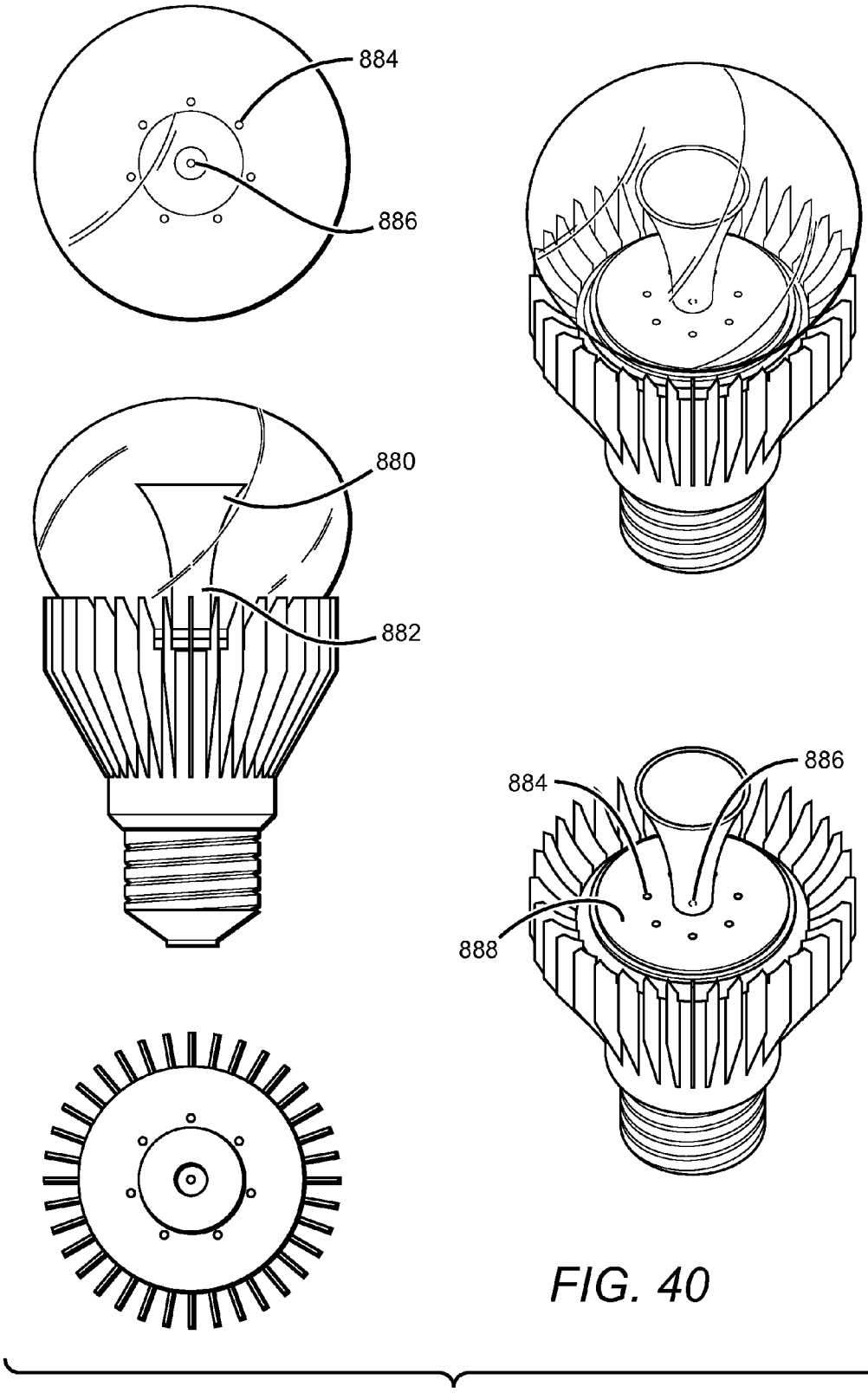
FIG. 40 is a perspective view of another embodiment of an optical element according to the present invention.

FIG. 40 shows an embodiment of an optical element 880. The optical element 880 is horn shaped, with an outer surface 882 that curves outward. The optical element 880 is completely hollow. An inner solid state emitter 886 is within the interior of the optical element 880 and on a carrier 888. A ring of solid state emitters 884 surrounds the base of the optical element 880. Some embodiments do not have an inner solid state emitter 886.

Figure 41:
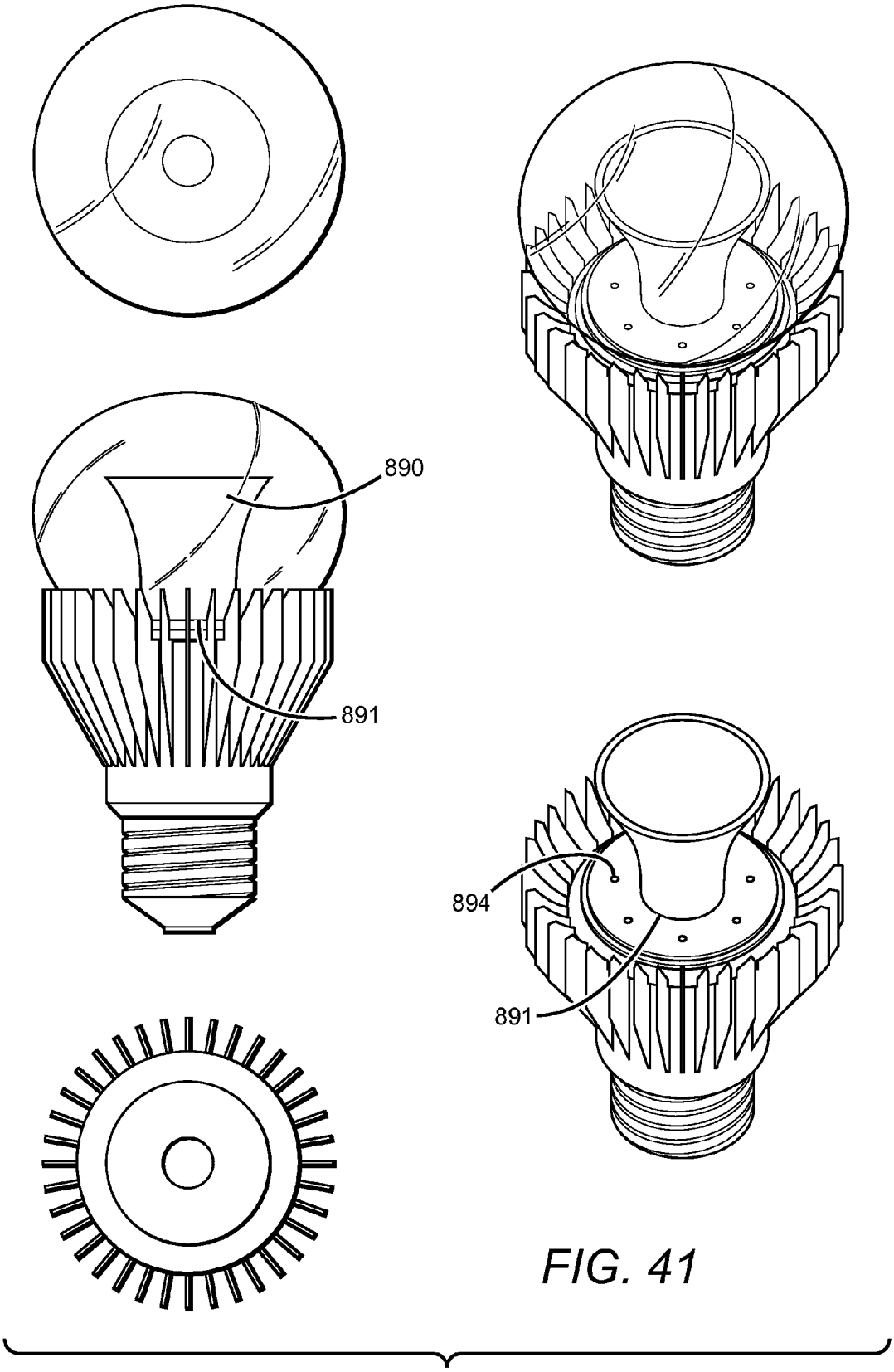
FIG. 41 is a perspective view of another embodiment of an optical element according to the present invention.

FIG. 41 shows an embodiment of an optical element 890. The optical element 890, like the optical element 880 of FIG. 40, is horn shaped, however the base 891 of the optical element 890 is wider than that of the optical element 880. The ring of outer solid state emitters 894 also has a larger radius than the ring of outer solid state emitters 884. The FIG. 41 embodiment does not include an inner solid state emitter, although other embodiments do comprise such an emitter.

Figure 42:
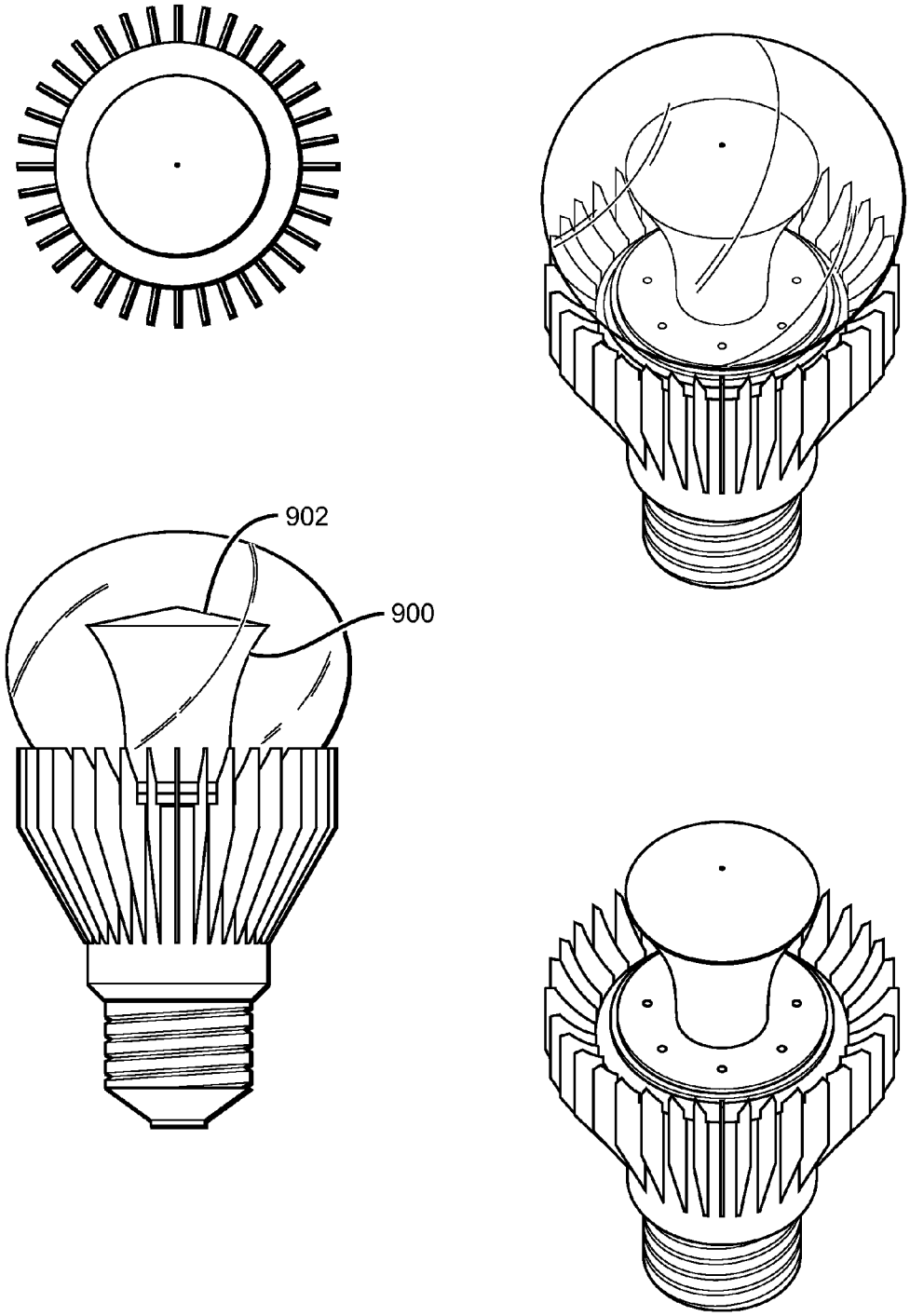
FIG. 42 is a perspective view of another embodiment of an optical element according to the present invention.

FIG. 42 shows an embodiment of an optical element 900. The optical element 900 comprises a pointed endcap 902. This endcap can help further distribute any light that reflects off of a diffuser and encounters the pointed endcap 902 in a more omnidirectional emission pattern. Embodiments of optical elements with pointed endcaps can help increase Energy Star compliance.

Figure 43:
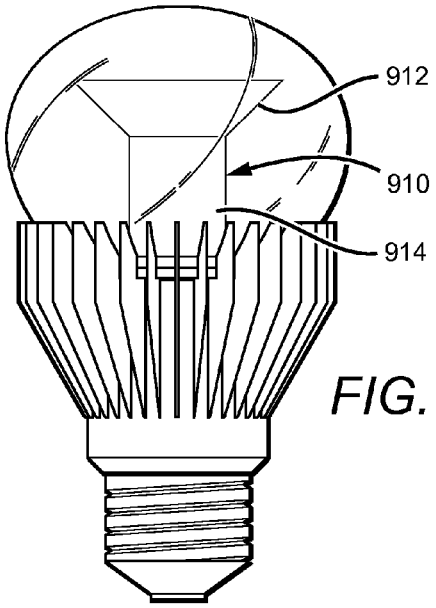
FIG. 43 is a perspective view of another embodiment of an optical element according to the present invention.

FIG. 43 shows an embodiment of an optical emitter 910. The optical element 910 is very similar to the optical emitter 300 from FIGS. 21A and 21B; however, the optical element 910 has a much longer cylindrical bottom portion 914 such that the upper portion 912 will sit much higher in a lamp. This can help avoid light reflecting off of the upper portion 912 and hitting the heat sink fins of a lamp, while still allowing light to emit from a lamp at high angles. In one embodiment, the bottom cylindrical portion 914 is approximately 25 mm high.

Figure 44:
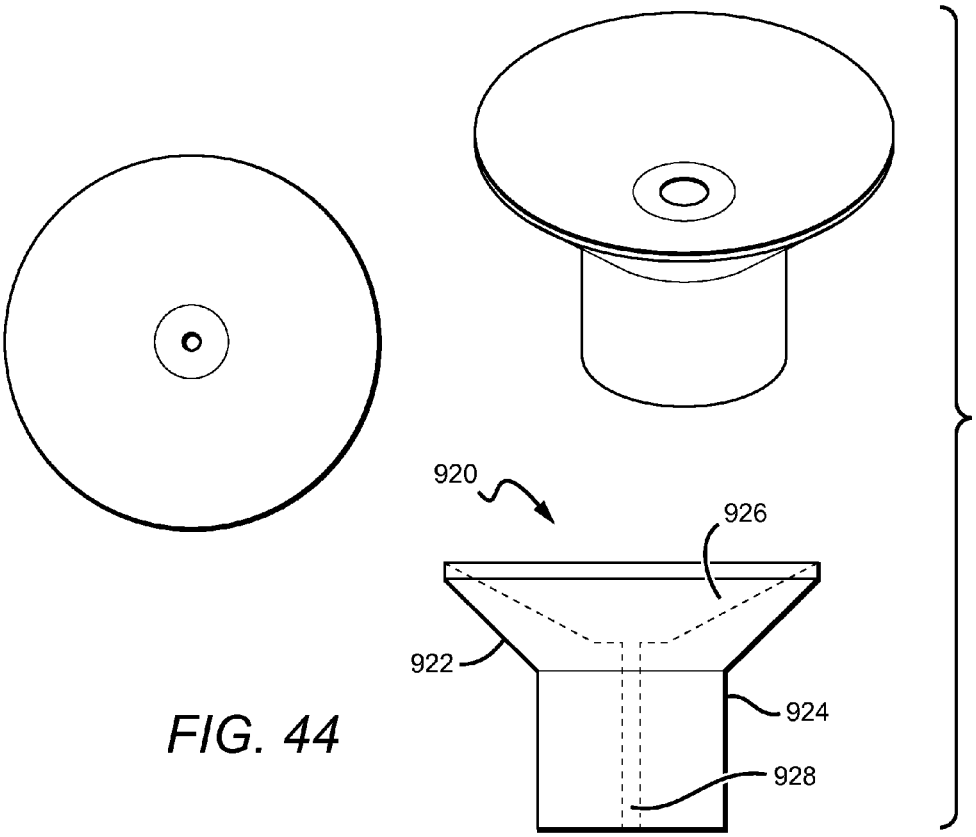
FIG. 44 is a perspective view of another embodiment of an optical element according to the present invention.

FIG. 44 shows an embodiment of an optical element 920. The optical element 920 has the same outer shape as the optical element 300 from FIGS. 21A and 21B. The optical element 920 is not, however, completely hollow like the optical element 300. Instead, the top portion 922 comprises a cavity 926 with sides that taper in from the outer surface of the top portion 922. The cavity 926 is connected to a through-hole cavity 928 which is cylindrical in shape. A solid state emitter can be placed at the bottom of the through-hole cavity 928.

Figure 45:
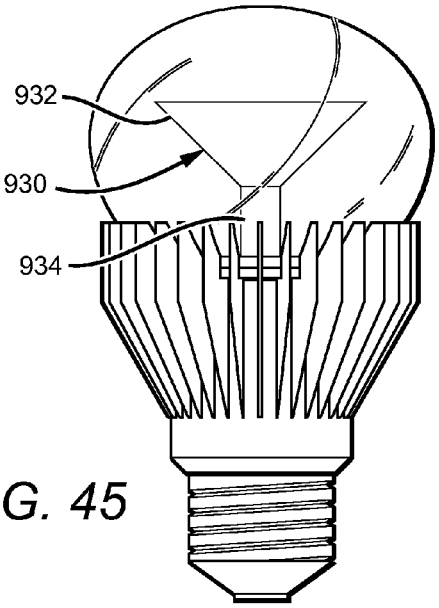
FIG. 45 is a perspective view of another embodiment of an optical element according to the present invention.

FIG. 45 shows an embodiment of yet another optical element 930. The optical element 930 is similar to the optical element 300 of FIGS. 21A and 21B; however, the lower portion 934 has a smaller radius than the lower portion 304. This can allow a ring of solid state emitters to have a smaller radius; in one embodiment, solid state emitters are placed in a ring with a small radius such that each solid state emitter is under the upper portion 932.

Figure 46:
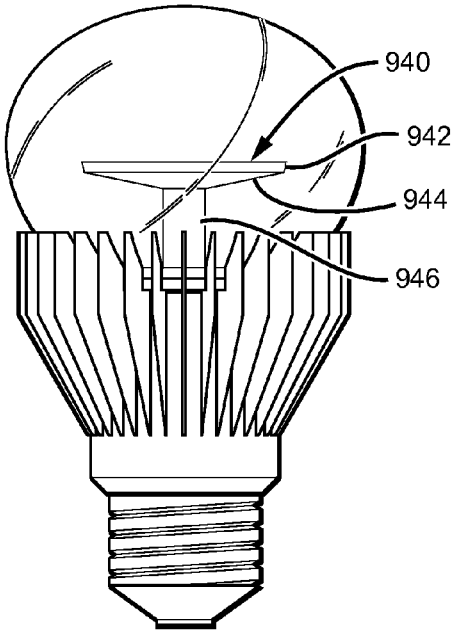
FIG. 46 is a perspective view of another embodiment of an optical element according to the present invention.

FIG. 46 shows an embodiment of yet another optical emitter 940. The optical element 940 comprises a disc shaped top portion 942, a frustoconical middle portion 944, and a cylindrical bottom portion 946. In the embodiment shown, the middle portion 944 has a very flat outer surface. This can help emitter light at very high angles. A similar embodiment may have only a cylindrical bottom portion and a frustoconical top portion with a relatively flat outer surface. Another similar embodiment may have only a cylindrical bottom portion and a disc shaped top portion with a completely flat surface, which can help the emitter emit light at very high angles. In embodiments with a frustoconical portion with a substantially flat outer surface, the outer surface can be angled at between approximately 10° and 20'.

Figure 47:
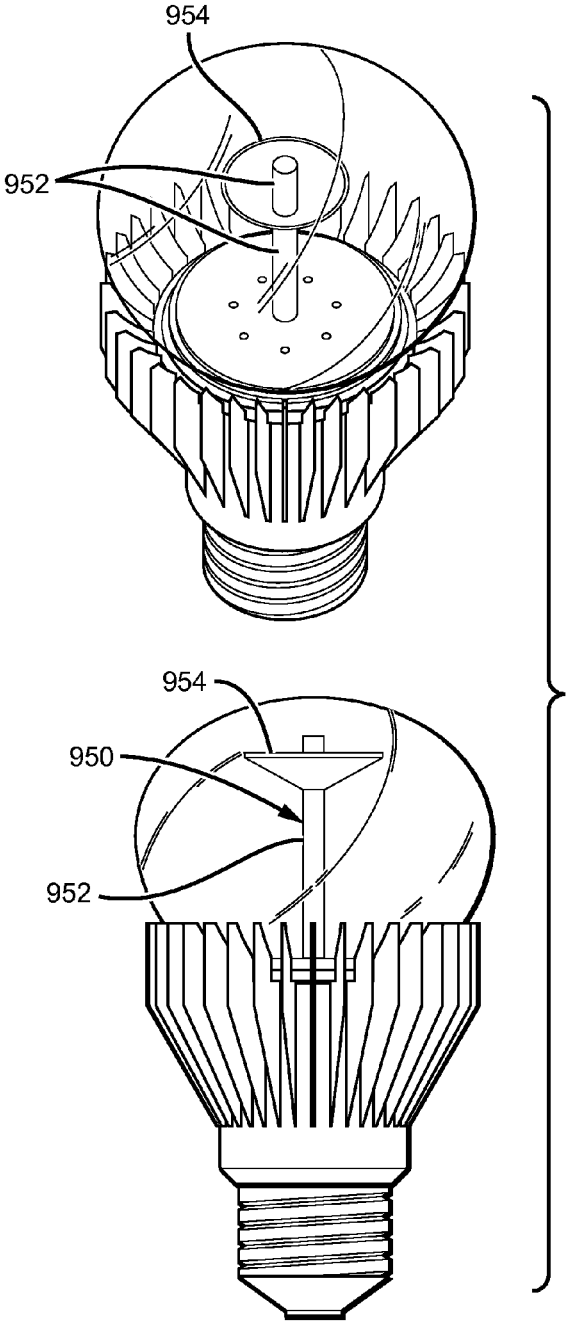
FIG. 47 is a perspective view of another embodiment of an optical element according to the present invention.
Figure 47:
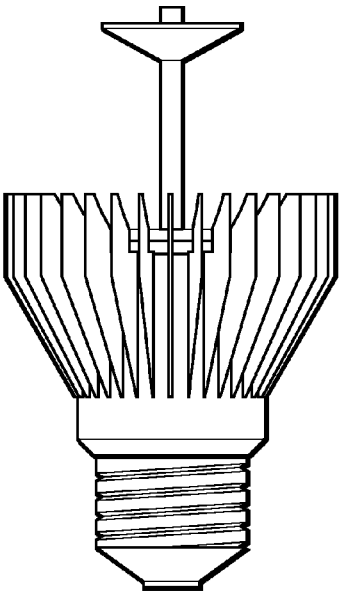

FIG. 47 shows an embodiment of yet another optical 950. The optical element 950 comprises an axial cylindrical portion 952 and a frustoconical portion 954. In the embodiment shown the frustoconical portion 954 is hollow, although in other embodiments it is not. The axial cylindrical portion 952 can comprise an axial hole.

FIG. 48 shows an embodiment of yet another optical element 960. The optical element 960 is similar to the optical element 920 of FIG. 44. However, the optical element 960 comprises a donut shaped portion 968 within the hollow portion 966. This donut shaped portion 968 can help light emit in a more omnidirectional pattern from a lamp. FIG. 49 shows another embodiment with a donut shaped portion 978; this donut shaped portion 978 can rise higher than the donut shaped portion 968. In the embodiment shown, the donut shaped portion 978 rises such that it is flush with the top of the frustoconical top portion 972. In some embodiments of the optical elements 960 and 970, the vast majority of light from a solid state emitter placed within the interior of the optical element 960 or 970 can emit at a forward angle; this is more true of the optical element 970, which has a higher donut shaped portion 978.

Figure 50:
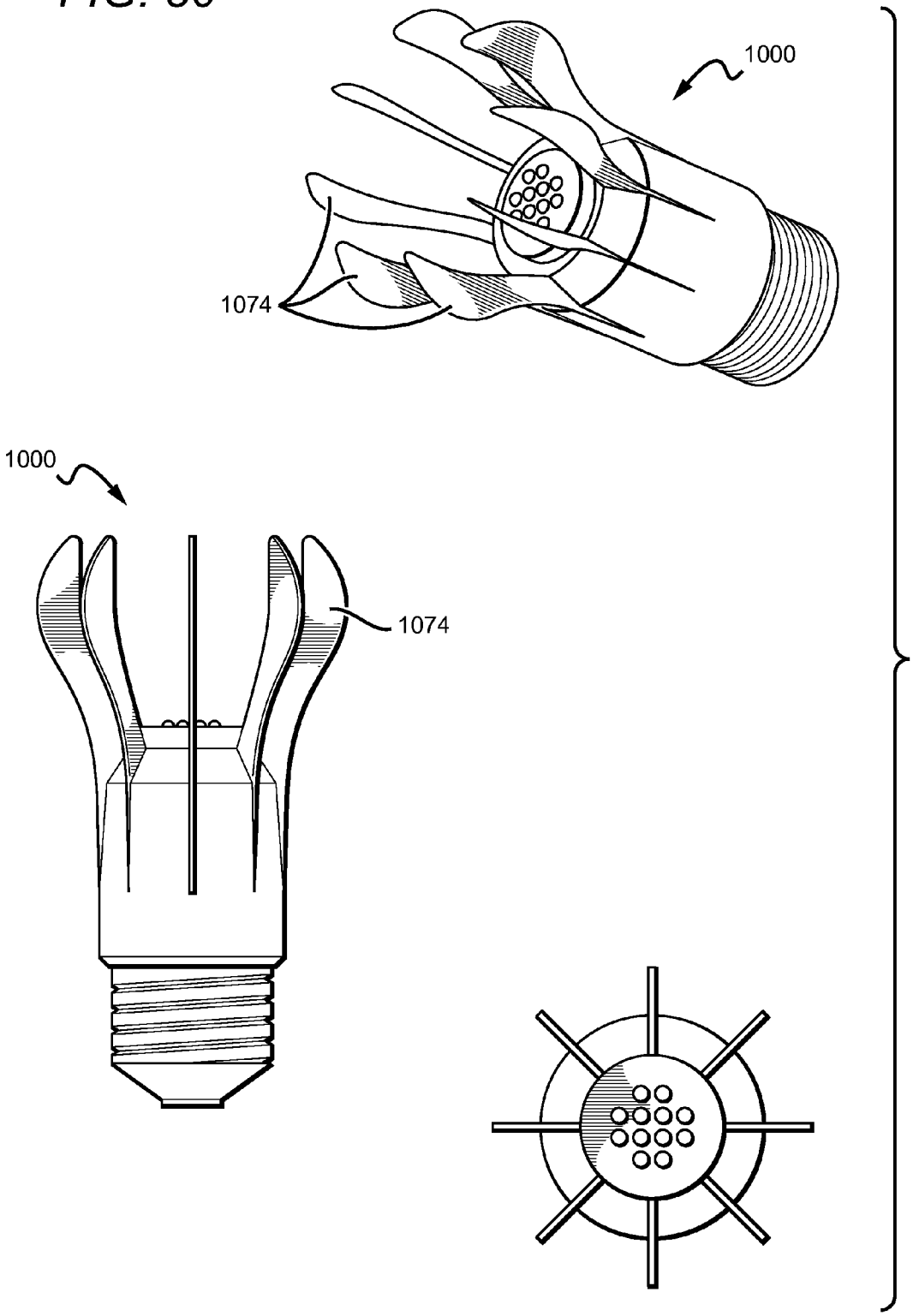
FIG. 50 is a perspective view of another embodiment of a heat sink according to the present invention.

FIG. 50 shows another embodiment of a heat sink 1000. The heat sink 1000 comprises fins 1074. As opposed to the heat sink 472 where the fins 474 are designed to be below the diffuser dome 478, the fins 474 are designed to wrap around a diffuser dome. This can allow more light to emit at high angles, since the fins 1074 will not block as much high angle light.

Many different optical element shapes are possible, including but not limited to embodiments combining characteristics of the embodiments described above. Further, any optical element shape can be combined with any of the different lamp components previously described in order to tailor the lamp's emission as desired.

Although the present invention has been described in detail with reference to certain preferred configurations thereof, other versions are possible. Therefore, the spirit and scope of the invention should not be limited to the versions described above.

We claim:

1. A solid state lamp, comprising:

an array of solid state emitters on a carrier;

a three-dimensional reflective optical element modifying the emission pattern of said array to produce a more omni-directional lamp emission pattern, said optical element comprising a bottom section and a top section comprising a reflective top outer surface, wherein a portion of said bottom section is adjacent to said carrier, wherein said reflective top outer surface spreads from said bottom section over said array of solid state emitters;

wherein said reflective top outer surface comprises a specular reflector and is not configured to operate by total internal reflection on light from said array; and wherein said reflective top outer surface comprises two or more sections separated by at least one space, such that light from said array of solid state emitters can pass through said at least one space.

2. The lamp of claim 1, wherein at least some light emitting from said array reflects off of said reflective top outer surface.

3. The lamp of claim 1, wherein said optical element comprises a cavity.

4. The lamp of claim 3, wherein said cavity extends through a length of said optical element.

5. The lamp of claim 3, wherein said array comprises at least one solid state emitter in said cavity.

6. The lamp of claim 1, wherein said array comprises more than one solid state emitter around a base of said optical element.

7. The lamp of claim 1, wherein said bottom section comprises a reflective bottom outer surface that is solid.

8. The lamp of claim 1, wherein said optical element is on said carrier.

9. The lamp of claim 1, wherein at least one of said solid state emitters is coated with phosphor.

10. The lamp of claim 9, wherein all of said solid state emitters are coated with phosphor.

11. The lamp of claim 1, wherein said array comprises red and BSY solid state emitters.

12. The lamp of claim 1, wherein said array of solid state emitters is planar.

13. The lamp of claim 1, wherein said optical element comprises a frustoconical top portion.

14. The lamp of claim 1, wherein said bottom section is cylindrical.

15. The lamp of claim 13, wherein the outer surface of said frustoconical top portion curves outward.

16. The lamp of claim 1, further comprising a diffuser;

wherein said diffuser comprises a bottom opening; and wherein the largest diameter of said optical element is equal to or smaller than the diameter of said bottom opening.

17. The lamp of claim 1, further comprising a diffuser surrounding said optical element;

wherein said optical element is within a bottom half of said diffuser.

18. The lamp of claim 13, wherein said frustoconical top portion is angled at approximately 45° from vertical.

19. The lamp of claim 1, wherein said optical element comprises three or more of said sections.

20. The lamp of claim 1, further comprising a diffuser around said optical element.

21. The lamp of claim 13, wherein said diffuser reflects at least some of said array light; and wherein said reflected light provides forward light emission for said lamp emission pattern.

22. The lamp of claim 20, wherein said diffuser is frustospherical.

23. The lamp of claim 22, wherein said diffuser is oblong.

24. The lamp of claim 20, wherein said diffuser is coated uniformly with diffusing particles or scattering particles.

25. The lamp of claim 24, wherein said diffuser is coated using a fill-and-dump method.

26. The lamp of claim 20, wherein a coating of diffusing particles or scattering particles on said diffuser is non-uniform.

27. The lamp of claim 26, wherein a lower portion of said diffuser is coated with more diffusing particles or scattering particles than an upper portion of said diffuser.

28. The lamp of claim 20, wherein said diffuser comprises a roughened surface.

29. The lamp of claim 1, wherein at least some of said solid state emitters are on a perimeter of said carrier.

30. The lamp of claim 1, wherein at least one of said solid state emitters is in a cavity of said optical element and on said carrier; and wherein the rest of said solid state emitters are on a perimeter of said carrier.

31. The lamp of claim 1, wherein at least one of said solid state emitters is in a cavity of said optical element and on said carrier; and wherein the rest of said solid state emitters form a ring around said optical element.

32. The lamp of claim 1, wherein at least some of said solid state emitters are directly below said reflective top outer surface.

33. The lamp of claim 1, wherein said array comprises eight solid state emitters.

34. The lamp of claim 1, wherein said array comprises ten solid state emitters.

35. The lamp of claim 1, wherein each of said solid state emitters has an emission profile broader than a Lambertian emission profile.

36. The lamp of claim 1, wherein each of said solid state emitters has a Lambertian emission profile.

37. The lamp of claim 1, wherein said top section comprises a top inner surface, and wherein said reflective top outer surface is more reflective than said top inner surface.

38. The lamp of claim 1, wherein said reflective top outer surface is white.

39. The lamp of claim 38, wherein said reflective top outer surface comprises white plastic sheets.

40. The lamp of claim 38, wherein said reflective top outer surface comprises white paper.

41. The lamp of claim 1, wherein said optical element is flower shaped.

42. The lamp of claim 1, wherein said top section comprises one or more reflective blades over said array with light from said array reflecting from said one or more reflective blades.

43. The lamp of claim 1, wherein said at least one space in said reflective top outer surface comprises a slot.

44. The lamp of claim 3, further comprising a phosphor carrier in said cavity.

45. The lamp of claim 3, further comprising a phosphor carrier over said optical element.

46. The lamp of claim 3, further comprising a phosphor carrier outside said optical element.

47. The lamp of claim 1, wherein said lamp fits within an A19 envelope.

48. The lamp of claim 1, wherein said lamp emits an emission pattern that is Energy Star compliant.

49. The lamp of claim 1, wherein said carrier is on a heat sink;

wherein said heat sink comprises a plurality of fins.

50. The lamp of claim 49, wherein said fins comprise an angled upper portion.

51. The lamp of claim 1, wherein said optical element is partially transmissive.

52. The lamp of claim 1, wherein said array comprises at least two different types of solid state emitters.

53. The lamp of claim 1, wherein said array comprises solid state emitters that emit at least two different wavelengths of light.

54. The lamp of claim 5, wherein said at least one solid state emitter in said cavity is different than the rest of said solid state emitters in said array.

55. The lamp of claim 1, wherein said optical element is thermally conductive.

56. The lamp of claim 1, wherein said reflective top outer surface comprises a diffuse reflector.

57. The lamp of claim 1, wherein said optical element comprises at least one surface that is a diffuse reflector.

58. A three-dimensional optical element for use in a solid state lamp, said optical element comprising:

a top section comprising a reflective top outer surface; and a bottom section, wherein said reflective top outer surface spreads from said bottom section such that said optical element has a tapered outer profile, and wherein said reflective top outer surface comprises an opaque material to reflect light from a solid state emitter; and wherein said reflective top outer surface comprises two or more sections separated by at least one space, such that light can pass through said at least one space.

59. The optical element of claim 58, further comprising a reflective inner surface.

60. The optical element of claim 58, wherein said optical element comprises a frustoconical top portion.

61. The optical element of claim 58, wherein said bottom section is cylindrical.

62. The optical element of claim 60, wherein the outer surface of said frustoconical top portion curves outward.

63. The optical element of claim 58, wherein said frustoconical top portion is angled at approximately 45° from vertical.

64. The optical element of claim 58, wherein said optical element comprises a first surface that is more reflective than a second surface.

65. The optical element of claim 64, wherein said first surface is an outer surface of a frustoconical top section.

66. The optical element of claim 58, wherein said material is white.

67. The optical element of claim 58, wherein said material comprises white plastic sheets.

68. The optical element of claim 58, wherein said material comprises white paper.

69. A three-dimensional optical element for use in a solid state lamp, said optical element comprising:

a bottom section, and a top section integral with said bottom section and spreading from said bottom section, said top section comprising a series of blades with open spaces between and through adjacent ones of said blades, an outside surface of each of said blades being reflective.

70. The optical element of claim 69, wherein said bottom section is substantially cylindrical, and wherein said blades curve from said bottom section.

71. The optical element of claim 69, wherein said blades increase in width moving up the optical element.

72. The optical element of claim 69, wherein the outside surface of each of said blades is opaque.

73. The optical element of claim 69, wherein the outside surface of each of said blades does not operate by total internal reflection.

74. The optical element of claim 69, wherein the outside surface of each of said blades is non-transmissive.

75. The optical element of claim 69, wherein the outside surface of each of said blades comprises a specular reflector.

76. The optical element of claim 69, wherein the outside surface of each of said blades comprises a diffuse reflector.

77. The optical element of claim 58, wherein said material is a specular reflector.

78. The optical element of claim 58, wherein said top outer surface comprises a plurality of said spaces each separating two of said sections of said top outer surface.

79. The optical element of claim 58, wherein said material is non-transmissive.

* * * * *